US008857598B2

(12) United States Patent
Iizuka et al.

(10) Patent No.: US 8,857,598 B2
(45) Date of Patent: Oct. 14, 2014

(54) PAPER SHEET CONVEYING DEVICE AND AUTOMATIC CASH TRANSACTION DEVICE

(75) Inventors: Yuta Iizuka, Gunma (JP); Jumpei Nagao, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 167 days.

(21) Appl. No.: 13/552,151

(22) Filed: Jul. 18, 2012

(65) Prior Publication Data

US 2013/0043106 A1 Feb. 21, 2013

(30) Foreign Application Priority Data

Aug. 17, 2011 (JP) ..... 2011-178400

(51) Int. Cl.
*B65G 47/46* (2006.01)
*B65H 29/58* (2006.01)

(52) U.S. Cl.
CPC ..... *B65H 29/58* (2013.01); *B65H 2701/1912* (2013.01); *B65H 2301/3124* (2013.01); *B65H 2404/63* (2013.01); *B65H 2404/612* (2013.01)
USPC ..... 198/370.01; 198/368; 271/303; 271/184

(58) Field of Classification Search
CPC .... B65H 29/58; B65H 29/60; B65H 2404/63; B65H 2404/632; B65G 47/74; B65G 47/82; B65G 2201/02; B65G 47/52; B65G 47/53
USPC ..... 271/3.19, 225, 287, 296, 297, 303, 184; 198/370.01, 351, 368
See application file for complete search history.

(56) References Cited

U.S. PATENT DOCUMENTS

| | | | | |
|---|---|---|---|---|
| 5,088,722 | A * | 2/1992 | Olexy | 271/304 |
| 5,746,424 | A * | 5/1998 | Rutten et al. | 271/303 |
| 6,554,266 | B2 * | 4/2003 | Nanba et al. | 271/69 |
| 6,565,274 | B1 * | 5/2003 | Lyons | 271/303 |
| 8,167,304 | B2 * | 5/2012 | Fukazawa et al. | 271/225 |
| 2007/0205552 | A1 * | 9/2007 | Taniguchi | 271/303 |

FOREIGN PATENT DOCUMENTS

| | | | | |
|---|---|---|---|---|
| GB | 549067 | * | 11/1942 | 271/303 |
| GB | 2174368 | * | 11/1986 | 271/303 |
| JP | 2010-272024 A | | 12/2010 | |

* cited by examiner

*Primary Examiner* — James R Bidwell
(74) *Attorney, Agent, or Firm* — Rabin & Berdo, P.C.

(57) ABSTRACT

There is provided a paper sheet conveying device of the present invention has: at least three or more conveying paths that are for conveying paper sheets and at each of which at least a partial segment is formed in an arc shape; and at least one or more switching portions for switching the conveying path that conveys the paper sheets, wherein the plural conveying paths are disposed such that two connection positions of each of the arc-shaped segments are connected to the connection position of the arc-shaped segment of a respectively different one of the conveying paths such that outer sides of arcs face one another, and the switching portion switches the conveying path that conveys the paper sheets, at a place of connection of the plural conveying paths.

6 Claims, 14 Drawing Sheets

PAPER SHEET CONVEYING DEVICE AND AUTOMATIC CASH TRANSACTION DEVICE

CROSS-REFERENCE TO RELATED APPLICATION

This application claims priority under 35 USC 119 from Japanese Patent Application No. 2011-178400, filed Aug. 17, 2011, the disclosure of which is incorporated by reference herein.

BACKGROUND

1. Technical Field

The present invention relates to a paper sheet conveying device and an automatic cash transaction device, and is suited for application to, for example, Automatic Teller Machines (ATMs) that carry out depositing and dispensing of cash.

2. Related Art

In conventional automatic transaction devices, at the time of a bill deposit transaction, the bills that have been inserted into a customer interface section by a customer are conveyed to a discriminating section where the denomination, the state and the like of the bills are discriminated, and in continuation thereafter, the bills are conveyed to a temporary holding section. Due thereto, the bills are held in this temporary holding section, and the deposit is reserved temporarily.

Then, in the state in which the bills are held in the temporary holding section, when the amount of the deposit is confirmed by the customer at the automatic transaction device, the bills that are held are conveyed from the temporary holding section to the discriminating section again and are discriminated thereat, and in continuation thereafter, are conveyed to and stored in bill storage cassettes.

However, in the state in which bills are held in the temporary holding section, when return of the bills is requested by the customer at the automatic transaction device, the bills that were held in the temporary holding section are conveyed to the customer interface section and returned to the customer.

Further, when the amount to be withdrawn is designated by the customer at the time of a bill dispensing transaction at the automatic transaction device, bills in the amount to be withdrawn are conveyed from the bill storage cassettes to the discriminating section and discriminated thereat, and thereafter, are conveyed to the customer interface section and handed-over to the customer.

Moreover, at the automatic transaction device, when, for example, there are bills that have been left behind that a customer has forgotten to take from the customer interface section at the time of a dispensing transaction, the bills that have been left behind are conveyed from the customer interface section to the discriminating section and discriminated thereat, and thereafter, are conveyed to the bill storage cassettes and stored and kept therein.

At this time, the automatic transaction device stores, as left-behind bill information, information such as the denominations and the amount and the like of the left-behind bills that are stored in the bill storage cassettes.

Then, when a customer requests the return of bills that have been left behind, the automatic transaction device conveys bills from the bill storage cassettes to the discriminating section and discriminates them, and further, judges, in accordance with the left-behind bill information, whether or not the bills discriminated at the discriminating section correspond to the left-behind bills that should be returned to the customer.

As a result, from among the bills discriminated at the discriminating section, the automatic transaction device conveys, from the discriminating section to the customer interface section, the bills that correspond to the left-behind bills that should be returned to the customer, and returns these bills to the customer.

In contrast, from among the bills discriminated at the discriminating section, the automatic transaction device conveys, from the discriminating section to the temporary holding section, the bills that do not correspond to the left-behind bills that should be returned to the customer, and holds these bills in the temporary holding section. After the left-behind bills are returned to the customer, the bills held in the temporary holding section are conveyed from the temporary holding section to the bill storage cassettes and stored therein.

In this way, the automatic transaction device carries out deposit transactions and withdrawal transactions of bills that are desired by customers, and returns bills that a customer has forgotten to take from the customer interface section (see, for example, Japanese Patent Application Laid-Open (JP-A) No. 2010-272024).

Further, in an automatic transaction device of this structure, for example, a conveying path is disposed from the discriminating section to the customer interface section, and a conveying path is disposed also from a predetermined position on the aforementioned conveying path to the temporary storage section.

Note that, in the following description, the conveying path that is disposed from the predetermined position on the conveying path, that is between the discriminating section and the customer interface section, to the temporary holding section is also specially called the holding side conveying path.

Further, in the following description, on the conveying path that is disposed between the discriminating section and the customer interface section, the region from the discriminating section to the predetermined position is also specially called the discriminating side conveying path, and the region from the predetermined position to the customer interface opening is also specially called the customer interface side conveying path.

In the automatic transaction device, at the places of connection of the discriminating side conveying path, the customer side conveying path and the holding side conveying path, the path along which a bill is conveyed is switched to any of the discriminating side conveying path, the customer interface side conveying path and the holding side conveying path.

Due thereto, the automatic transaction device conveys a bill from the discriminating device as described above successively via the discriminating side conveying path and the holding side conveying path to the temporary holding section, and conveys a bill from the temporary holding section successively via the holding side conveying path and the discriminating side conveying path to the discriminating section.

Further, the automatic transaction device conveys a bill from the temporary holding section successively via the holding side conveying path and the customer interface side conveying path to the customer interface section, and conveys a bill from the discriminating section successively via the discriminating side conveying path and the customer interface side conveying path to the customer interface section. Moreover, the automatic transaction device conveys a bill from the temporary holding section successively via the holding side conveying path and the discriminating side conveying path to the discriminating section.

However, in the automatic transaction device, when the discriminating side conveying path, the customer interface side conveying path and the holding side conveying path are connected at angles of 90° or less for example, due to the sudden change in the conveying direction when bills through the places of connection thereof, it is easy for the leading ends of the bills to catch on the walls or the like of the discriminating side conveying path, the customer interface side conveying path or the holding side conveying path and lose their shape and become congested, i.e., it is easy for a so-called jam to occur.

Further, in the automatic transaction device, when jamming of a bill occurs in the vicinity of a place of connection of the discriminating side conveying path, the customer interface side conveying path and the holding side conveying path, there is the problem that, while that bill is being removed, the conveying of other bills must be stopped and the conveying efficiency deteriorates.

SUMMARY

The present invention was made in view of the above-described points, and proposes a paper sheet conveying device and an automatic cash transaction device that can prevent a deterioration in the efficiency of conveying paper sheets.

In order to overcome the aforementioned problem, in the present invention, there are provided at least three or more conveying paths that are for conveying paper sheets and at each of which at least a partial segment is formed in an arc shape; and at least one or more switching portions for switching the conveying path that conveys the paper sheets, and the plural conveying paths are disposed such that two connection positions of each of the arc-shaped segments are connected to the connection position of the arc-shaped segment of a respectively different one of the conveying paths such that outer sides of arcs face one another, and the conveying path that conveys the paper sheets is switched by the switching portion at a place of connection of the plural conveying paths.

In accordance with the present invention, there are provided at least three or more conveying paths that are for conveying paper sheets and at each of which at least a partial segment is formed in an arc shape, and at least one or more switching portions for switching the conveying path that conveys the paper sheets. The plural conveying paths are disposed such that two connection positions of each of the arc-shaped segments are connected to the connection position of the arc-shaped segment of a respectively different one of the conveying paths, such that the outer sides of the arcs face one another. The conveying path that conveys the paper sheets is switched by the switching portion at a place of connection of the plural conveying paths. Due thereto, there can be realized a paper sheet conveying device and an automatic cash transaction device in which, even when paper sheets are conveyed with the conveying path thereof being switched from any of the conveying paths to any other of the conveying paths at a place of connection of the plural conveying paths, the conveying direction is prevented from changing suddenly when the paper sheets pass through the place of connection, and the occurrence of jams can be greatly reduced, and therefore, a decrease in the efficiency of conveying the paper sheets can be prevented.

BRIEF DESCRIPTION OF THE DRAWINGS

Exemplary embodiments of the present invention will be described in detail based on the following figures, wherein.

DETAILED DESCRIPTION

Best forms for embodying the invention (hereinafter also called exemplary embodiments) are described hereinafter by using the drawings. Note that explanation is given in the following order.

(1) First Exemplary Embodiment
(2) Second Exemplary Embodiment
(3) Third Exemplary Embodiment
(4) Fourth Exemplary Embodiment
(5) Fifth Exemplary Embodiment

(1) First Exemplary Embodiment

(1-1) External Structure of Automatic Teller Machine

Figure 1:
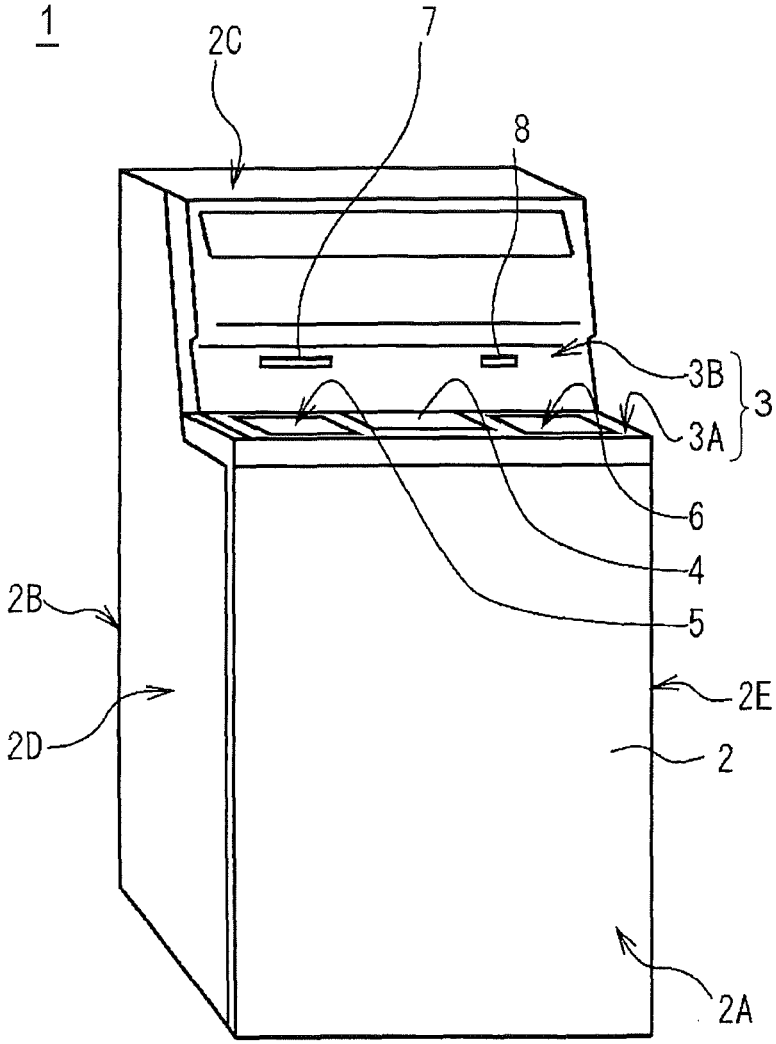
FIG. 1 is a rough perspective view showing an exemplary embodiment of the external structure of an automatic teller machine in accordance with the present invention.

In FIG. 1, 1 shows the external structure overall of an automatic teller machine to which the present invention is applied. This automatic teller machine 1 has a device housing 2 that is substantially box shaped.

A front panel 3, which is formed in a substantial L-shape so as to be recessed further toward a rear surface 2B side than a front surface 2A of the device housing 2, is provided at the upper end portion of the front side of the device housing 2.

Note that, in the following explanation, the front surface 2A of the device housing 2 is also called the device front surface 2A, and the rear surface 2B of the device housing 2 is also called the device rear surface 2B.

Further, in the following explanation, the direction from the device front surface 2A toward the device rear surface 2B is also called the rearward direction, and the direction from the device rear surface 2B toward the device front surface 2A is also called the forward direction.

In the following explanation, a top surface 2C of the device housing 2 is also called a device top surface 2C. The direction from the bottom surface of the device housing 2 toward the device top surface 2C is also called the upward direction, and the direction from the device top surface 2C toward the bottom surface of the device housing 2 is also called the downward direction.

Further, in the following explanation, a side surface 2D at the left when viewed facing the device housing 2 and the front panel 3 is also called the device left side surface 2D, and a side surface 2E at the right is also called the device right side surface 2E.

In the following explanation, the direction from the device left side surface 2D toward the device right side surface 2E is also called the rightward direction, and the direction from the device right side surface 2E toward the device left side surface 2D is also called the leftward direction.

In this case, a touch screen 4 is provided at, for example, the central portion of an upwardly-facing panel 3A that is substantially horizontal (i.e., substantially parallel to the device top surface 2C) and faces upward at the front panel 3.

Further, a coin insertion/take-out section 5, that is box-shaped and is used for the insertion and taking-out of coins, is provided, for example, toward the left of the upwardly-facing panel 3A of the front panel 3.

A bill insertion/take-out section 6, that is box-shaped and is used for the insertion and taking-out of rectangular bills, is provided, for example, toward the right of the upwardly-facing panel 3A of the front panel 3.

The touch screen 4 is formed by a transparent touch panel for operation input being affixed on the display surface of a display portion such as a liquid crystal display or an organic EL (Electro Luminescence) display for displaying various types of operation images.

Shutters are provided so as to freely open and close at the openings of the coin insertion/take-out section 5 and the bill insertion/take-out section 6, and are for opening and closing these openings respectively in accordance with the contents of the transaction.

On the other hand, a bankbook insertion/ejection opening 7, for the insertion of a bankbook and the ejection of the bankbook or a transaction statement, is provided, for example, toward the left of a forward-facing panel 3B that faces forward and is substantially vertical (i.e., substantially parallel to the device front surface 2A) at the front panel 3.

Further, a card insertion/ejection opening 8, for the insertion and ejection of various types of cards such as cash cards, credit cards and the like, also is provided, for example, toward the right of the forward-facing panel 3B at the front panel 3.

Note that a reading/printing processing section (not illustrated), that is for reading customer information such as the account number recorded in the bankbook, and the like, and is for printing contents of the transaction or the like in the bankbook or on a transaction statement, is provided within the device housing 2 at the rear side of the bankbook insertion/ejection opening 7.

A card processing section (not illustrated), that is for reading customer information, such as the account number of the customer, the code for the financial institution and the like that are recorded on various cards, and the like, is provided within the device housing 2 at the rear side of the card insertion/ejection opening 8.

On the basis of this structure, the automatic teller machine 1 displays operation images on the touch screen 4, and appropriately switches and displays the operation images in accordance with the touch operation by the customer on the surface of the touch screen 4.

Due thereto, the automatic teller machine 1 guides the customer via the operation images through the processes of the desired transaction, such as depositing like the entrusting of cash or dispensing like the reimbursing of cash, or the like.

Further, in accordance with this guidance, the automatic teller machine 1 has the user insert his/her bankbook or card into the bankbook insertion/ejection opening 7 or the card insertion/ejection opening 8, and has the user insert coins or bills into the coin insertion/take-out section 5 or the bill insertion/take-out section 6.

Moreover, in accordance with this guidance, the automatic teller machine 1 has the user take the bankbook or transaction statement or card that is ejected from the bankbook insertion/ejection opening 7 or the card insertion/ejection opening 8, and has the user take coins or cash from the coin insertion/take-out section 5 or the bill insertion/take-out section 6.

In this way, the automatic teller machine 1 can carry out transactions such as the depositing and dispensing of cash and the like that are desired by a customer.

(1-2) Internal Structure of Automatic Teller Machine

The internal structure of the automatic teller machine is described next by using FIG. 2. Because the present invention relates to the conveying of paper sheets, hereinafter, description focuses on sections that handle bills that serve as paper sheets, and description of the sections that handle coins and the like is omitted.

Portions at the aforementioned bill insertion/take-out section 6, other than the shutter (not illustrated) that is provided at the opening, are housed within the automatic teller machine 1.

In this case, a placement stand 6A, on which plural bills are placed in, for example, a sideways-upright state in which the bills stand with ones of the long sides thereof being the bottom sides, is provided within the bill insertion/take-out section 6.

A separation/draw-out mechanism 6B, which is for separating one-by-one the plural bills that are on the placement stand 6A and drawing a bill out downwardly, is provided within the bill insertion/take-out section 6 near to the lower side of the front of the placement stand 6A.

A take-in/stacking mechanism 6C, which is for successively taking-in the bills that are conveyed one-by-one upwardly from the lower side of the bill insertion/take-out section 6 and placing them in the sideways-upright states on the placement stand 6A, is provided within the bill insertion/take-out section 6 near to the lower side of the rear of the placement stand 6A.

A partitioning plate 6D, which partitions the bill accommodating space on the placement stand 6A at a desired position into a region at the front and a region at the rear, is provided within the bill insertion/take-out section 6 so as to be moveable in the forward direction and the rearward direction.

Moreover, a discriminating section 10, that discriminates the denominations, states and the like of bills, is disposed at the lower side of the bill insertion/take-out section 6 within the automatic teller machine 1.

A temporary holding section 11, that, at the time of a deposit of bills for example, takes the bills into the interior and temporarily holds the bills so as to temporarily reserve the deposit, is disposed at the rear side of the bill insertion/take-out section 6 within the automatic teller machine 1.

Note that a take-in/draw-out mechanism 11A, that takes into the temporary holding section 11 bills that are conveyed one-by-one from the front side in the rearward direction, and separates one-by-one bills that are within the temporary holding section 11 and draws a bill out in the forward direction, is provided within the temporary holding section 11.

Further, a lower unit 12 is disposed within the automatic teller machine 1 at the lower side of the discriminating section 10 and the temporary holding section 11. Plural bill storage cassettes (not illustrated) that store bills per denomination are provided in the lower unit 12.

A conveying path 13 (hereinafter also called distribution conveying path), that conveys the bills, that have been conveyed from the discriminating section 10 side, so as to distribute the bills to the bill storage cassettes corresponding to the denominations, and conveys, to the discriminating section 10 side, bills that have been drawn-out from the plural bill storage cassettes, and the like also are provided at the lower unit 12.

Further, plural conveying paths for conveying bills between the bill insertion/take-out section 6, the discriminating section 10, the temporary holding section 11 and the lower unit 12, are disposed within the automatic teller machine 1.

Namely, a conveying path (hereinafter also called draw-out side conveying path) 15, that is substantially L-shaped and whose one end is connected to the bill draw-out end of the separation/draw-out mechanism 6B, is disposed at the lower side of the bill insertion/take-out section 6 such that the one end portion thereof is parallel to the upward direction and the other end thereof is directed in the rearward direction and faces the bill take-in/discharge opening at the front side of the discriminating section 10 (hereinafter also called discrimination front side take-in/discharge opening).

A conveying path 16 (hereinafter also called front side conveying path), that is rectilinear and whose one end is connected to the other end of the draw-out side conveying path 15 and whose other end is connected to the discrimination front side take-in/discharge opening, is disposed parallel to the rearward direction at the lower side of the bill insertion/take-out section 6.

A conveying path (hereinafter also called unit side conveying path) 17, that is substantially L-shaped, and whose one end that is directed rearward is connected to the other end of the feed-out side conveying path 15 and to the one end of the front side conveying path 16, and whose other end is connected to the one end of the distribution conveying path 13, is disposed with its other end portion parallel to the upward direction, at the lower side of the bill insertion/take-out section 6.

A switching portion 18, for switching the conveying path used in the conveying of the bills, is disposed in a vicinity of the place of connection of the draw-out side conveying path 15, the front side conveying path 16 and the unit side conveying path 17.

The switching portion 18 switches the conveying direction of a bill, that is conveyed via the draw-out side conveying path 15, so as to lead that bill to the front side conveying path 16.

Further, the switching portion 18 switches the conveying direction of a bill, that is conveyed via the front side conveying path 16, so as to lead that bill to the unit side conveying path 17. Or, the switching portion 18 switches the conveying direction of a bill, that is conveyed via the unit side conveying path 17, so as to lead that bill to the front side conveying path 16.

In this way, the switching portion 18 switches the path that, together with the front side conveying path 16, is used for conveying a bill, to one of the draw-out side conveying path 15 and the unit side conveying path 17.

On the other hand, a bill conveying section 19, that has plural paths for connecting the bill insertion/take-out section 6, the discriminating section 10 and the temporary holding section 11 together and for conveying bills, is provided between the bill insertion/take-out section 6, the discriminating section 10 and the temporary holding section 11.

The bill conveying section 19 has a conveying path 20 that is connected to the discriminating section 10 and at which a partial segment is formed in an arc shape, a conveying path 21 that is connected to the temporary holding section 11 and at which a partial segment is formed in an arc shape, and a conveying path 22 that is connected to the bill insertion/take-out section 6 and at which a partial segment is formed in an arc shape.

Note that, in the following description, the conveying path 20, that is connected to the discriminating section 10 and at which a partial segment is formed in an arc shape, is also called the discriminating side conveying path 20, and the conveying path 21, that is connected to the temporary holding section 11 and at which a partial segment is formed in an arc shape, is also called the holding side conveying path 21.

Further, in the following description, the conveying path 22 that is connected to the bill insertion/take-out section 6 and at which a partial segment is formed in an arc shape, is also called the insertion/take-out side conveying path 22.

The discriminating side conveying path 20 is structured from a conveying path (hereinafter also called rear side conveying path) 23 that is formed rectilinearly, and a conveying path (hereinafter also called first arc-shaped conveying path) 24 that overall is formed in an arc shape.

The rear side conveying path 23 is disposed in a posture of being parallel to the rearward direction, and with one end thereof connected to a bill take-in/discharge opening of the discriminating section 10 (hereinafter also called discrimination rear side take-in/discharge opening).

Further, the first arc-shaped conveying path 24 is disposed in a posture in which almost all of the outer side of the arc faces the rearward direction, and such that one end thereof is connected to the other end of the rear side conveying path 23, and the other end thereof is positioned in a vicinity of the take-in/stacking mechanism 6C.

The holding side conveying path 21 is structured from a conveying path (hereinafter also called second arc-shaped conveying path) 25 that overall is formed in an arc shape, and a conveying path (hereinafter also called third arc-shaped conveying path) 26 whose one end portion is formed in an arc shape.

The second arc-shaped conveying path 25 is disposed in a posture in which the outer side of the arc faces the forward direction, and with one end thereof connected to a predetermined connection position (hereinafter also called first connection position) of the first arc-shaped conveying path 24.

Further, the third arc-shaped conveying path 26 is disposed in a posture in which the outer side of the arc faces the forward direction, and such that one end thereof is connected to the other end of the second arc-shaped conveying path 25, and the other end thereof is connected to the take-in/draw-out end of the take-in/draw-out mechanism 11A and extends the arc of the second arc-shaped conveying path 25 toward the temporary holding section 11 side.

The insertion/take-out side conveying path 22 is structured from a conveying path (hereinafter also called fourth arc-shaped conveying path) 27 that overall is formed in an arc shape, and a conveying path (hereinafter also called fifth arc-shaped conveying path) 28 whose one end portion and central portion are formed in arc shapes.

The fourth arc-shaped conveying path 27 is disposed in a posture in which the outer side of the arc faces the rearward direction, and with one end thereof connected to the other end of the second arc-shaped conveying path 25 and the one end of the third arc-shaped conveying path 26, and the other end thereof connected to the other end of the first arc-shaped conveying path 24.

Further, the fifth arc-shaped conveying path 28 is disposed in a posture in which the outer side of the arc at the one end portion faces a side that is inclined downward and rearward, and the outer side of the arc at the central portion faces a side that is inclined downward and forward, and with one end thereof connected to the other end of the first arc-shaped conveying path 24 and the other end of the fourth arc-shaped conveying path 27, and the other end thereof connected to the bill take-in end of the take-in/stacking mechanism 6C.

Note that, in the following description, the first arc-shaped conveying path 24, the second arc-shaped conveying path 25, the third arc-shaped conveying path 26, the fourth arc-shaped conveying path 27 and the fifth arc-shaped conveying path 28 are also simply called arc-shaped conveying paths if there is no particular need to discriminate therebetween.

Figure 3:
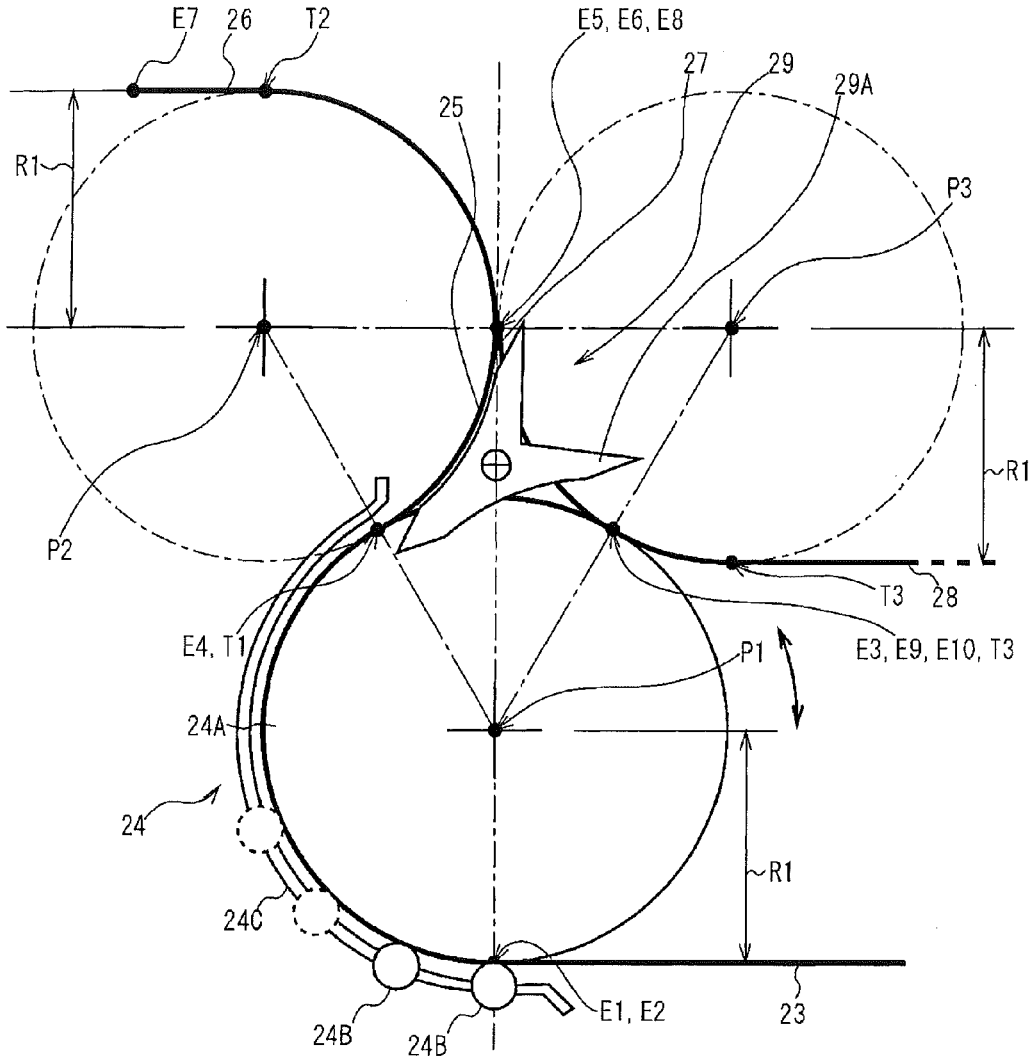
FIG. 3 is a rough line drawing showing the structures of arc-shaped conveying paths and a switching portion.

Here, as shown in FIG. 3, the first arc-shaped conveying path 24 is formed by using, as a reference, the circumference of a circle at which a predetermined position directly above another end E1 of the rear side conveying path 23 is center (hereinafter also called first center) P1, and the distance from this other end E1 to the center P1 is radius (hereinafter also called first radius) R1.

Namely, given that, on this circumference, the intersection point with an imaginary line that extends directly downward from the first center P1 is one end E2, and that the intersection point with an imaginary line that extends from the first center P1 in a direction that is inclined 30° toward the front side with respect to directly above the first center P1 is other end E3, the first arc-shaped conveying path 24 is formed so as to convey a bill along the arc between the one end E2 and the other end E3 (i.e., in an arc shape).

At the first arc-shaped conveying path 24, with the one end E2 being one point on the circumference, the rear side conveying path 23 is positioned on a tangent line at this one point, and the other end E1 of the rear side conveying path 23 is connected to this one end E2.

Accordingly, the first arc-shaped conveying path 24 can transfer a bill between itself and the rear side conveying path 23 without suddenly changing the conveying direction.

In actuality, a conveying driving section for conveying bills is provided at the first arc-shaped conveying path 24. This conveying driving section has a drive shaft (not illustrated), and, for example, one drive roller 24A that is solid-cylindrical, plural tension shafts (not illustrated), plural tension rollers 24B, a conveying guide 24C, a motor (not illustrated), and the like.

In this case, the drive shaft is supported at the first center P1 so as to be rotatable in one direction and the other direction in a posture of being parallel to the leftward direction, and one end of the drive shaft is connected to the driving shaft of the motor.

Further, the drive roller 24A has a radius that is equal to the first radius R1, and groove portions, which extend over the circumference of the drive roller 24A, are formed in the peripheral side surface at predetermined intervals along the longitudinal direction of the drive roller 24A.

A hole portion (not illustrated) is formed in the center of the drive roller 24A, and the drive roller 24 is mounted to the drive shaft via this hole portion at the center.

Accordingly, due to the conveying driving section driving and rotating the drive shaft via the motor, the drive roller 24A can be rotated in one direction and the other direction around the drive shaft (i.e., the first center P1).

Further, the plural tension shafts are supported so as to be able to rotate in one direction and the other direction in a posture of being parallel to the leftward direction respectively, at predetermined intervals in a vicinity of the peripheral side surface of the drive roller 24A, at the range from the one end E2 to the other end E3 of the first arc-shaped conveying path 24. The plural tension shafts are respectively urged in the direction of the first center P1.

The plural tension rollers 24B respectively have the same radius that is smaller than the first radius R1, and hole portions (not illustrated) are formed in the centers thereof.

A predetermined number of the plural tension rollers 24B are mounted at predetermined intervals to each tension shaft via the hole portions at the centers thereof, so as to face the peripheral side surface of the drive roller 24A (i.e., regions of the peripheral side surface other than the groove portions).

Accordingly, due to the plural tension shafts being urged, the conveying driving section can push the respective peripheral side surfaces of the plural tension rollers 24B against the peripheral side surface of the drive roller 24A.

Accordingly, when the conveying driving section rotates the drive roller 24A in the one direction and the other direction, interlockingly therewith, the plural tension rollers 24B can be rotated around the tension shafts in the other direction or the one direction that is opposite to the drive roller 24A.

The conveying guide 24C is formed in a substantial arc shape so as to go along, for example, the circumference of a circle whose radius is slightly larger than the first radius R1. Hole portions, which pass through from the outer surface to the inner surface, are formed in the conveying guide 24C in correspondence with the positions where the plural tension rollers 24B are disposed.

The corresponding tension rollers 24B are inserted respectively into the plural hole portions of the conveying guide 24C, and the conveying guide 24C is disposed, for example, so as to extend from a vicinity of the one end E2 of the first arc-shaped conveying path 24 to a vicinity of the position of connection with the second arc-shaped conveying path 25, and such that the inner surface of the conveying guide 24C is adjacent to the peripheral side surface of the drive roller 24A.

On the basis of this structure, when a bill is conveyed via the rear side conveying path 23 as described later, the conveying driving section of the first arc-shaped conveying path 24 rotates the drive roller 24A in the one direction.

Due thereto, the conveying driving section of the first arc-shaped conveying path 24 takes-in the bill from the one end E2 side so as to nip the bill between the drive roller 24A and the sets of the tension rollers 24B successively, and, on the other hand, pushes the bill out at the other end E3 side and conveys the bill to the second arc-shaped conveying path 24 or the fifth arc-shaped conveying path 28.

Further, when a bill is conveyed via the second arc-shaped conveying path 25 as described later, the conveying driving section of the first arc-shaped conveying path 24 rotates the drive roller 24A in the other direction.

Due thereto, the conveying drive section of the first arc-shaped conveying path 24 takes-in the bill from the other end E3 side so as to nip the bill between the drive roller 24A and the sets of the tension rollers 24B successively, and, on the other hand, pushes the bill out at the one end E2 side and conveys the bill to the rear side conveying path 23.

At the first arc-shaped conveying path 24, the first radius R1 of the arc is set so as to be relatively large. Therefore, the conveying driving section of the first arc-shaped conveying path 24 conveys the bill along an arc that is relatively gradual.

Accordingly, at the conveying driving section of the first arc-shaped conveying path 24, the centrifugal force that is applied to the bill that is being conveyed is made to be as small as possible, and floating-up of the bill from the peripheral side surface of the drive roller 24A is greatly reduced.

Further, even if the bill starts to float up, the conveying driving section of the first arc-shaped conveying path 24 pushes the bill to return toward the drive roller 24A side by the inner surface of the conveying guide 24C that is adjacent to the peripheral side surface of the drive roller 24A, and can guide the bill between the drive roller 24A and the plural tension rollers 24B.

Due to the inner surface of the conveying guide 24C being set adjacent to the peripheral side surface of the drive roller 24A, the conveying driving section of the first arc-shaped conveying path 24 guides and conveys the bill that is being conveyed such that, for example, the bill does not catch on the gears that are for connecting the drive shaft and the motor, or the like.

Further, at the conveying driving section of the first arc-shaped conveying path 24, the interval at which the plural tension shafts are placed is appropriately set to, for example, less than or equal to one-half of the short-side direction length of the bills that are the object of conveying, and the number of the tension shafts as well is set appropriately in accordance with the placement interval and the length of the arc of the first arc-shaped conveying path 24.

Accordingly, at the conveying driving section of the first arc-shaped conveying path 24, when one long-side end portion of a bill that is being conveyed is pushed out from between the drive roller 24A and one set of the tension rollers 24B, that one long-side end portion of the bill can be nipped in by the next one set of tension rollers 24B without hardly floating-up at all.

In this way, the conveying driving section of the first arc-shaped conveying path 24 can convey a bill along an arc without the bill catching on the tension rollers 24B, or the gears for connecting the drive shaft and the motor, or the like.

On the other hand, the second arc-shaped conveying path 25 is formed by using, as a reference, the circumference of a circle that has the first radius R1 and at which a position, that is separated from the first center P1 by a distance that is equal to two times the first radius R1 in a direction that is tilted 30° toward the rear side with respect to directly above the first center P1, is a center (hereinafter also called second center) P2.

Namely, given that, on this circumference, the intersection point with an imaginary line, which extends from the second center P2 in a direction that is inclined 30° toward the front side with respect to directly beneath the second center P2, is one end E4, and that the intersection point with an imaginary line, that extends horizontally (i.e., directly laterally) in the rightward direction from this second center P2, is other end E5, the second arc-shaped conveying path 25 is formed so as to convey a bill along the arc between the one end E4 and the other end E5 (i.e., in an arc shape).

At the second arc-shaped conveying path 25, the one end E4 is connected to a first connection position T1, which is on the first arc-shaped conveying path 24 and that intersects an imaginary line that connects the first center P1 and the second center P2, such that the outer sides of the arcs face one another.

Namely, the second arc-shaped conveying path 25 is connected to the first arc-shaped conveying path 24 such that the tangent line of the one end E4 coincides with the tangent line of the first connection position T1 of this first arc-shaped conveying path 24, and such that the second arc-shaped conveying path 25, and the region of the first arc-shaped conveying path 24 from the one end E2 to the first connection position T1, draw a gradual, backward S-shape.

Accordingly, the second arc-shaped conveying path 25 receives, at the one end E4 and without suddenly changing the conveying direction, a bill that is conveyed from the one end E2 of the first arc-shaped conveying path 24 to the first connection position T1 as described later, and can convey the bill in continuation to the other end E5.

Further, the second arc-shaped conveying path 25 causes the first arc-shaped conveying path 24 to receive, at the first connection position T1 and without suddenly changing the conveying direction, a bill that is conveyed from the other end E5 to the one end E4 as described later, and can cause the first arc-shaped conveying path 24 to convey the bill in continuation from the first connection position T1 to the one end E2.

Figure 4:
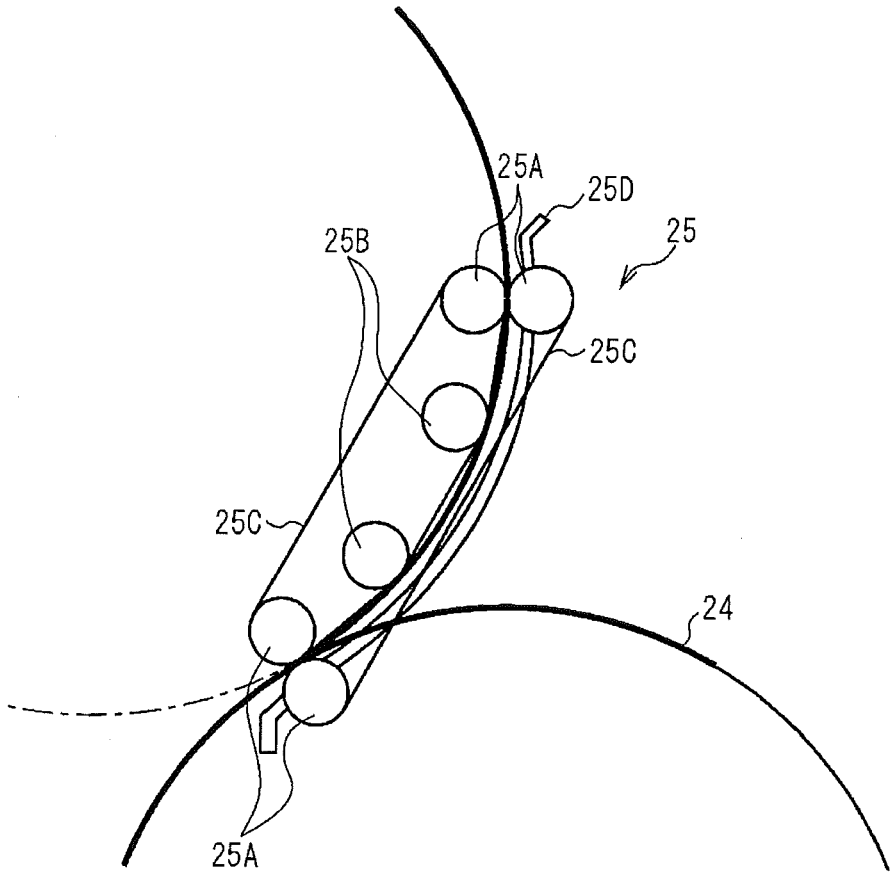
FIG. 4 is a rough line drawing showing the structure of a second arc-shaped conveying path.

In actuality, as shown in FIG. 4, a conveying driving section for conveying bills is provided at the second arc-shaped conveying path 25. This conveying driving section has plural drive shafts (not illustrated), plural motors (not illustrated), plural drive rollers 25A, plural idle shafts (not illustrated), plural idle rollers 25B, plural conveying belts 25C, a conveying guide 25D, and the like.

In this case, two of the plural drive shafts are supported so as to be rotatable in one direction and the other direction in a posture of being parallel to the leftward direction respectively, for example, on a normal line that passes through the one end E4 of the arc of the second arc-shaped conveying path 25, at two positions that oppose one another across this arc.

Further, another two of the plural drive shafts are supported so as to be rotatable in one direction and the other direction in a posture of being parallel to the leftward direction, for example, on a normal line that passes through the other end E5 of the arc of the second arc-shaped conveying path 25, at two positions that oppose one another across this arc. One end of each of these plural drive shafts is connected to the driving shaft of a motor.

The plural idle shafts are supported so as to be rotatable in one direction and the other direction in a posture of being parallel to the leftward direction respectively, at the region between one drive shaft and the other drive shaft that are at the inner side of the arc, at predetermined intervals along this arc.

On the other hand, the plural drive rollers 25A respectively have the same radius that is smaller than the first radius R1, and hole portions (not illustrated) are formed in the centers thereof.

A predetermined number of the plural drive rollers 25A are mounted at predetermined intervals to each drive shaft via the hole portions.

Further, the plural idle rollers 25B have radii that are equal to those of the drive rollers 25A, and hole portions (not illustrated) are formed in the centers thereof.

The plural idle rollers 25B are mounted at predetermined intervals (i.e., so as to be lined-up with the drive rollers 25A along the arc) to each idle shaft via the hole portions, in the same number as the number of the drive rollers 25A that are mounted to each drive shaft.

The plural conveying belts 25C are respectively trained from the ones of the drive rollers 25A that are lined-up in a row along the inner side of the arc, to the other drive rollers 25 via the plural idle rollers 25B, and portions of the surfaces of the conveying belts 25C are made to go along the arc.

Due thereto, when the conveying driving section, via the motors, drives and rotates the drive shafts that are disposed at the inner side of the arc, the plural drive rollers 25A are rotated in the one direction and the other direction around these drive shafts, and, interlockingly therewith, the conveying belts 25C can be rotated in the one direction and the other direction in a state in which portions of the surfaces thereof are made to go along the arc.

Further, the plural conveying belts 25C are also trained around the other drive rollers 25A from the ones of the drive rollers 25A that are lined-up in a row along the outer side of the arc, and portions of the surfaces thereof are pushed against portions of the surfaces of the facing conveying belts at the inner side of the arc.

The conveying driving section rotates and drives the drive shafts, which are disposed at the outer side of the arc, via the motors so as to rotate these drive shafts in the direction opposite the drive shafts that are disposed at the inner side of the arc.

Accordingly, when the conveying driving section rotates and drives, via the motors, the drive shafts that are disposed at the inner side of the arc, the conveying driving section rotates the plural drive rollers 25A in the other direction and the one direction around these drive shafts, and, interlockingly therewith, rotates the conveying belts 25C in the other direction and the one direction that are opposite thereto, while pushing the conveying belts 25C against the conveying belts 25C that rotate at the inner side of the arc.

In addition, the conveying guide 25D is formed in a substantial arc shape so as to go along the circumference of a circle whose radius is slightly larger than the first radius R1 for example. Hole portions, which pass-through from the outer side to the inner side, are formed in the conveying guide 25D in correspondence with the plural conveying belts 25C that are positioned at the outer side of the arc.

The conveying belts 25C that correspond to the outer side of the arc are respectively inserted into the plural hole portions of the conveying guide 25D, and the conveying guide 25D is disposed, for example, from a vicinity of the one end E4 of the second arc-shaped conveying path 25 to a vicinity of the other end E5, with the inner surface thereof being adjacent to the surfaces of the conveying belts 25C that are at the inner side of the arc.

On the basis of this structure, when a bill is conveyed via the first arc-shaped conveying path 24 as described later, the conveying driving section of the second arc-shaped conveying path 25 rotates the conveying belts 25C at the inner side and the outer side of the arc in the other direction and the one direction that are opposite to one another.

Due thereto, the conveying driving section of the second arc-shaped conveying path 25 takes-in the bill from the one end E4 side so as to nip the bill between the conveying belts 25C that face one another, and, on the other hand, pushes the bill out at the other end E5 side and conveys the bill to the third arc-shaped conveying path 26.

Further, when a bill is conveyed via the third arc-shaped conveying path 26 as described later, the conveying driving section of the second arc-shaped conveying path 25 rotates the conveying belts 25C at the inner side and the outer side of the arc in the one direction and the other direction that are opposite to one another.

Due thereto, the conveying driving section of the second arc-shaped conveying path 25 takes-in the bill from the other end E5 side so as to nip the bill between the conveying belts 25C that face one another, and, on the other hand, pushes the bill out at the one end E4 side and conveys the bill to the first arc-shaped conveying path 24.

The radius of the arc of the second arc-shaped conveying path 24 is set to the first radius R1 that is relatively large. Therefore, in the same way as the first arc-shaped conveying path 24, the conveying driving section of the second arc-shaped conveying path 25 as well conveys a bill along a relatively gradual arc.

Accordingly, at the conveying driving section of the second arc-shaped conveying path 25, the centrifugal force that is applied to the bill that is being conveyed is made to be as small as possible, and floating-up of portions of the bill other than the portion nipped by the conveying belts 25C is greatly reduced.

Further, due to the inner surface of the conveying guide 25D being set adjacent to the surfaces of the conveying belts 25D at the inner side of the arc, the conveying driving section of the second arc-shaped conveying path 25 guides and conveys the bill that is being conveyed such that, for example, the bill does not catch on the gears that are for connecting the drive shafts and the motors, or the like.

In this way, the conveying driving section of the second arc-shaped conveying path 25 can convey a bill along an arc without the bill catching on the gears for connecting the drive shafts and the motors, or the like.

The third arc-shaped conveying path 26 (FIG. 3) is formed by using, as a reference, the circumference of a circle that has the first radius R1 and whose center is the second center P2.

Namely, given that, on this circumference, the intersection point with an imaginary line, which extends horizontally (i.e., directly laterally) in the rightward direction from this second center P2, is one end E6, and that the intersection point with an imaginary line that extends directly upward of the second center P2 is first arc end position T2, the third arc-shaped conveying path 26 is formed such that one end side thereof conveys a bill along the arc between the one end E4 and the first arc end position T2 (i.e., in an arc shape).

Further, the third arc-shaped conveying path 26 is formed such that the other end side from the first arc end position T2 to another end E7 conveys a bill along a tangent line (i.e., horizontally) at the first arc end position T2 of this circumference (i.e., conveys the bill rectilinearly).

Note that, in the following explanation, at the third arc-shaped conveying path 26, the portion from the first arc end position T2 to the other end E7 is also called the other end side horizontal portion.

Further, at the third arc-shaped conveying path 26, the one end E6 is connected to the other end E5 of the second arc-shaped conveying path 25, such that the outer sides of these arcs face the same rightward direction.

Namely, the third arc-shaped conveying path 26 is connected to the second arc-shaped conveying path 25 such that the tangent line of the one end E6 coincides with the tangent line of the other end E5 of the second arc-shaped conveying path 25, and such that one arc is formed by the second arc-shaped conveying path 25 and the portion of the third arc-shaped conveying path 26 from its own one end E6 to the first arc end position T2.

Accordingly, the third arc-shaped conveying path 26 receives a bill, which is conveyed from the one end E4 to the other end E5 of the second arc-shaped conveying path 25 as described later, at the one end E6 without suddenly changing the conveying direction thereof, and can convey the bill in continuation to the other end E7.

Further, the third arc-shaped conveying path 26 causes the second arc-shaped conveying path 25 to receive a bill, which is conveyed from the other end E7 to the one end E6 as described later, without suddenly changing the conveying direction, and causes the second arc-shaped conveying path 25 to convey the bill in continuation from the other end E5 to the one end E4.

In actuality, a conveying driving section, which is basically structured similarly to the conveying driving section of the second arc-shaped conveying path 25, is provided at the third arc-shaped conveying path 26.

Accordingly, in the same way as the conveying driving section of the second arc-shaped conveying path 25, the conveying driving section of the third arc-shaped conveying path 26 also can convey a bill along an arc and a tangent line of that arc, without the bill catching on the gears for connecting the drive shafts and the motors, or the like.

Further, the fourth arc-shaped conveying path 27 (FIG. 3) is formed by using, as a reference, the circumference of a circle that has the first radius R1 and at which a position, which is separated from the first center P1 by a distance that is equal to two times the first radius R1 in a direction that is tilted 30° toward the front side with respect to directly above the first center P1, is a center (hereinafter also called third center) P3.

Namely, given that, on this circumference, the intersection point with an imaginary line, which extends from the third center P3 horizontally (i.e., directly laterally) in the leftward direction, is one end E8, and that the intersection point with an imaginary line, which extends from the third center P3 in a direction inclined 30° toward the rear side with respect to directly beneath the third center P3, is another end E9, the fourth arc-shaped conveying path 27 is formed so as to convey a bill along the arc between the one end E8 and the other end E9 (i.e., in an arc shape).

At the fourth arc-shaped conveying path 27, the one end E8 is connected to the one end E6 of the third arc-shaped conveying path 26 (and the other end E5 of the second arc-shaped conveying path 25), such that the outer sides of these arcs face one another.

Namely, the fourth arc-shaped conveying path 27 is connected to the third arc-shaped conveying path 26 (and the second arc-shaped conveying path 25) such that the tangent line of the one end E8 coincides with the tangent line of the one end E6 of the third arc-shaped conveying path 26 (and the tangent line of the other end E5 of the second arc-shaped conveying path 25), and such that the fourth arc-shaped conveying path 27, and the region of the third arc-shaped conveying path 26 from the first arc end position T2 to the one end E6, draw a gradual, backward S-shape.

Accordingly, the fourth arc-shaped conveying path 27 receives, at the one end E8 and without suddenly changing the conveying direction, a bill that is conveyed from the other end E7 to the one end E6 of the third arc-shaped conveying path 26 as described later, and can convey the bill in continuation to the other end E9.

In actuality, a conveying driving section, which is basically structured similarly to the conveying driving section of the second arc-shaped conveying path 25, is provided at the fourth arc-shaped conveying path 27 as well.

Accordingly, in the same way as the conveying driving section of the second arc-shaped conveying path 25, the conveying driving section of the fourth arc-shaped conveying path 27 also can convey a bill along an arc without the bill catching on the gears for connecting the drive shafts and the motors, or the like.

In addition, one end side of the fifth arc-shaped conveying path 28 (FIG. 2 and FIG. 3) is formed by using, as a reference, the circumference of a circle that has the first radius R1 and whose center is the third center P3.

Namely, given that, on this circumference, the intersection point with an imaginary line, that extends from the third center P3 in a direction inclined 30° toward the rear side with respect to directly beneath the third center P3, is one end E10, and that the intersection point with an imaginary line, which extends directly beneath the third center P3, is a second arc end position T3, the fifth arc-shaped conveying path 28 is formed such that the one end side thereof conveys a bill along the arc between the one end E10 and the second arc end position T3 (i.e., in an arc shape).

Further, the fifth arc-shaped conveying path 28 is formed such that the region from the second arc end position T3 to the other end that is connected to the bill take-in end of the take-in/stacking mechanism 6C, is formed to convey the bill along a tangent line (i.e., horizontally) at the second arc end portion T3 on this circumference (i.e., to convey the bill rectilinearly), and thereafter, is bent in the upward direction.

Note that, in the following explanation, at the fifth arc-shaped conveying path 28, the portion that is formed in a horizontal rectilinear shape from the second arc end position T3 to the other end is also called the one end side horizontal portion.

However, the bent portion from the second arc end position T3 to the other end at the fifth arc-shaped conveying path 28 is formed by using, as a reference, the circumference of a circle whose radius is a length that is less than or equal to the first radius R1, and so as to convey a bill along an arc of a range of 90° of this circumference (i.e., an arc that is ¼ of the circumference of the circle whose radius is a length that is less than or equal to the first radius R1) (i.e., so as to convey a bill in an arc shape).

Further, the fifth arc-shaped conveying path 28 is formed such that the region from the arc-shaped bent portion to the other end conveys a bill along a tangent line (i.e., perpendicularly) of the circumference of the circle whose radius is a length that is less than or equal to the first radius R1 (i.e., conveys the bill rectilinearly).

The one end E10 of the fifth arc-shaped conveying path 28 is connected to the other end E9 of the fourth arc-shaped conveying path 27 such that the outer sides of these arcs face the same obliquely downward and rearward side.

Namely, the fifth arc-shaped conveying path 28 is connected to the fourth arc-shaped conveying path 27 such that the tangent line of the one end E10 coincides with the tangent line of the other end E9 of the fourth arc-shaped conveying path 27, and such that the fifth arc-shaped conveying path 28, together with the fourth arc-shaped conveying path 27, forms one arc that is longer than the fourth arc-shaped conveying path 27.

Further, the one end E10 of the fifth arc-shaped conveying path 28 is connected also to the other end E3 of the first arc-shaped conveying path 24. However, the fifth arc-shaped conveying path 28 is connected to the first arc-shaped conveying path 24 such that the tangent line of the one end E10 coincides with the tangent line of the other end E3 of the first arc-shaped conveying path 24 and the outer sides of the arcs face one another, and due thereto, a gradual, backward S-shape is drawn by the region from the one end E2 to the other end E3 of the first arc-shaped conveying path 24 and the region from the one end E10 to the second arc end position T3 of the fifth arc-shaped conveying path 28.

Accordingly, the fifth arc-shaped conveying path 28 receives a bill, which is conveyed from the one end E8 to the other end E9 of the fourth arc-shaped conveying path 27 as described later, at the one end E10 without suddenly changing the conveying direction thereof, and can convey the bill in continuation to the other end.

Further, the fifth arc-shaped conveying path 28 also receives a bill, which is conveyed from the one end E2 to the other end E3 of the first arc-shaped conveying path 24 as described later, at the one end E10 without suddenly changing the conveying direction thereof, and can convey the bill in continuation to the other end.

In actuality, a conveying driving section, which is basically structured similarly to the conveying driving section of the second arc-shaped conveying path 25, is provided at the fifth arc-shaped conveying path 28.

Accordingly, in the same way as the conveying driving section of the second arc-shaped conveying path 25, the conveying driving section of the fifth arc-shaped conveying path 28 also can convey a bill along an arc and a tangent line of this arc, without the bill catching on the gears for connecting the drive shafts and the motors, or the like.

The radii of the arcs of the first arc-shaped conveying path 24, the second arc-shaped conveying path 25 and the fourth arc-shaped conveying path 27 are set to be equal as described above, and the first arc-shaped conveying path 24, the second arc-shaped conveying path 25 and the fourth arc-shaped conveying path 27 are connected together at two connection positions with the outer sides of these arcs facing one another.

Accordingly, as is clear from FIG. 3, a space (hereinafter also called conveying path surrounded space) that is substantially triangular tube shaped and is parallel to the leftward direction, is formed at the portion that is surrounded by the arcs between the two connection positions of the first arc-shaped conveying path 24, the second arc-shaped conveying path 25 and the fourth arc-shaped conveying path 27, respectively.

Figure 2:
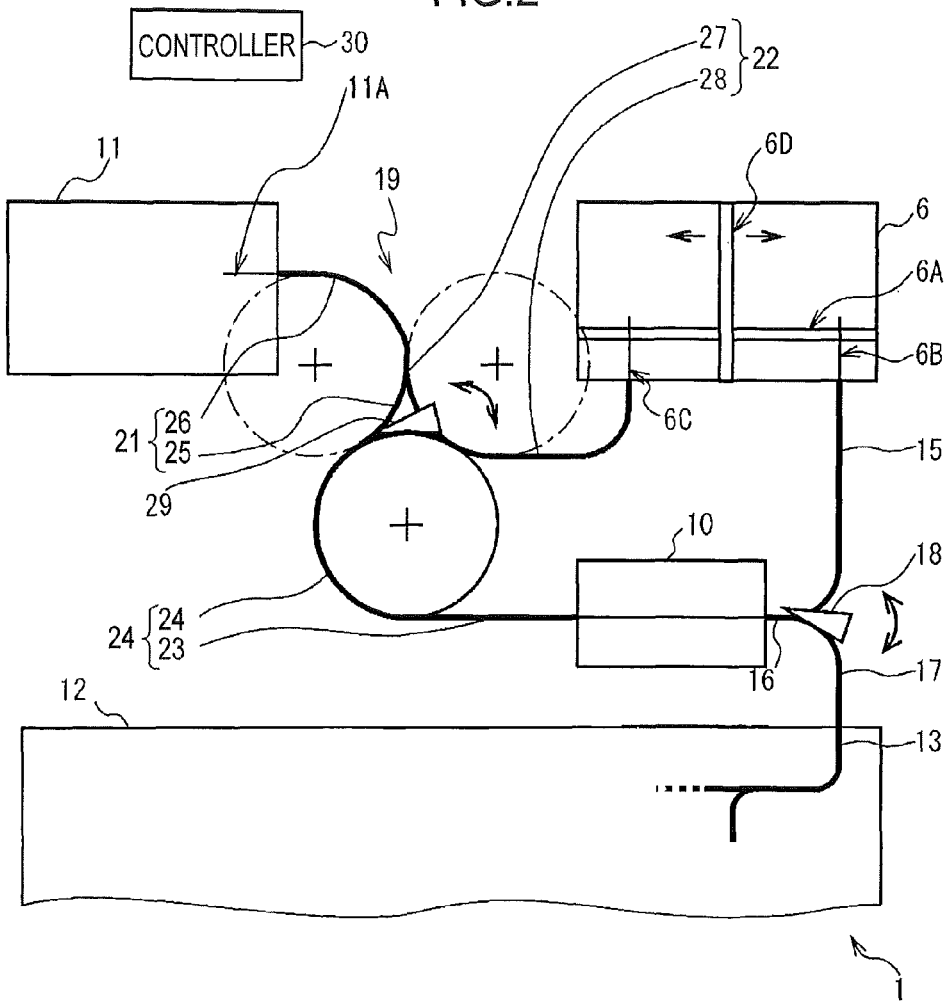
FIG. 2 is a rough line drawing showing the internal structure of an automatic teller machine in accordance with a first exemplary embodiment.

A switching portion 29, which is for switching the conveying path that is used in conveying a bill, is disposed at this conveying path surrounded space (FIG. 2 and FIG. 3).

The switching portion 29 has a drive shaft (not illustrated) that is disposed parallel to the leftward direction at a predetermined position on an imaginary line that extends directly upward from the first center P1 at the conveying path surrounded space (i.e., a predetermined position that is further upward than the first center P1 and that is on an imaginary line that is parallel to the upward direction and passes through the first center P1).

The switching portion 29 also has plural, substantially wedge-shaped switching blades 29A, and a hole portion is formed at the central portion of these switching blades 29A.

The plural switching blades 29A are mounted to the drive shaft via the hole portion in state in which the direction in which the distal ends thereof face are uniform, at predetermined intervals so as to not overlap the positions at which the above-described drive roller 24A, conveying belts 25C and the like are disposed.

The driving shaft of a stepping motor (not illustrated) is connected to one end of the drive shaft at the switching portion 29.

Due thereto, due to the drive shaft being driven to rotate via the stepping motor, the switching portion can rotate the plural switching blades 29A around the drive shaft in one direction and in the other direction without interfering with an above-described drive roller 24A and conveying belts and the like.

Figure 5:
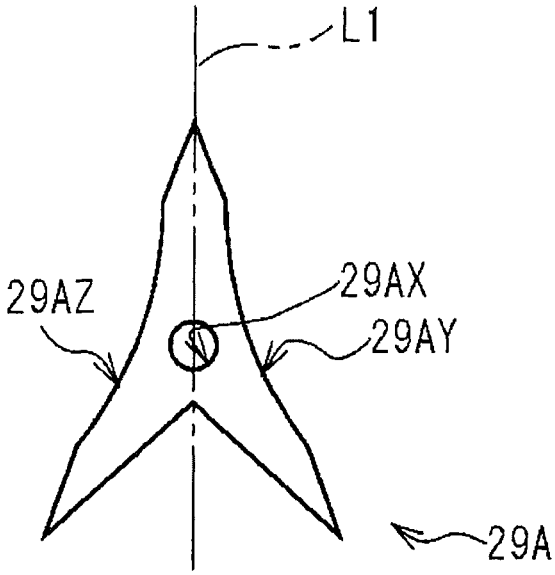
FIG. 5 is a rough line drawing showing the structure of a switching blade.

Here, as shown in FIG. 5, at the switching blade 29A, a portion toward one side surface and a portion toward the other side surface, which contact at an acute angle at the distal end (i.e., are connected in a V-shape), are formed so as to have line symmetry with respect to an imaginary line L1 that passes from the distal end through the center of a hole portion 29AX.

In actuality, the lengths of the one and the other side surfaces of the switching blade 29A are respectively set to be slightly longer than the length between the two connection positions of the first arc-shaped conveying path 24 (i.e., and also between the two connection positions of the second arc-shaped conveying path 25 and the fourth arc-shaped conveying path 27).

Further, cut-out portions 29AY, 29AZ, which are shaped as arcs that are similar to the arc shapes (i.e., the shapes and lengths of the arcs, and the heights from the connection points to the vertices) that are between the two connection positions of the first arc-shaped conveying path 24, are formed at the switching blade 29A respectively at the central portion of the one side surface and the central portion of the other side surface.

Note that, in the following description, the cut-out portions 29AY, 29AZ, which are arc-shaped and which are formed at the one and the other side surfaces of the switching blade 29A, are also called arc-shaped cut-out portions 29AY, 29AZ.

Further, the angle between the one and the other side surfaces of the switching blade 29A is appropriately set such that, when the switching blade 29A rotates in the conveying path surrounded space, the one arc-shaped cut-out portion 29AY and the other arc-shaped cut-out portion 29AZ are switched and made to go along the region between the two connection positions of any of the arc-shaped conveying paths, in accordance with the direction in which the distal end faces.

Figure 6A:
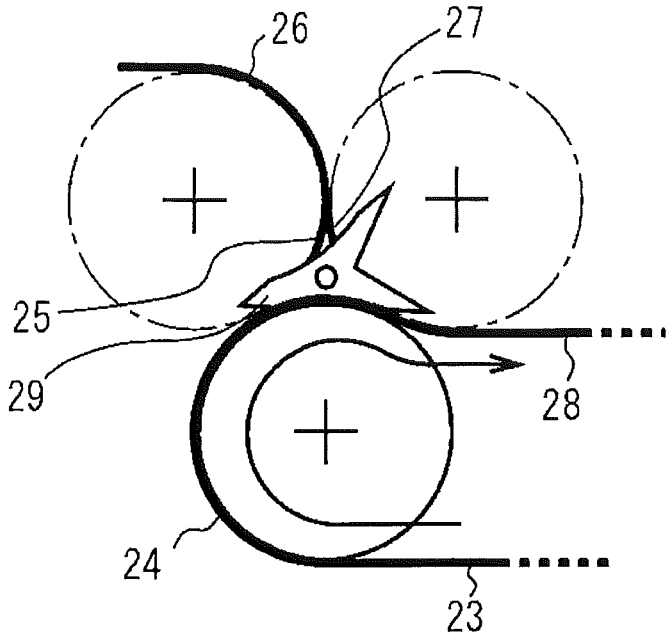
FIG. 6A is a rough line drawing that provides an explanation of switching of the conveying path by the switching blades.
Figure 6B:
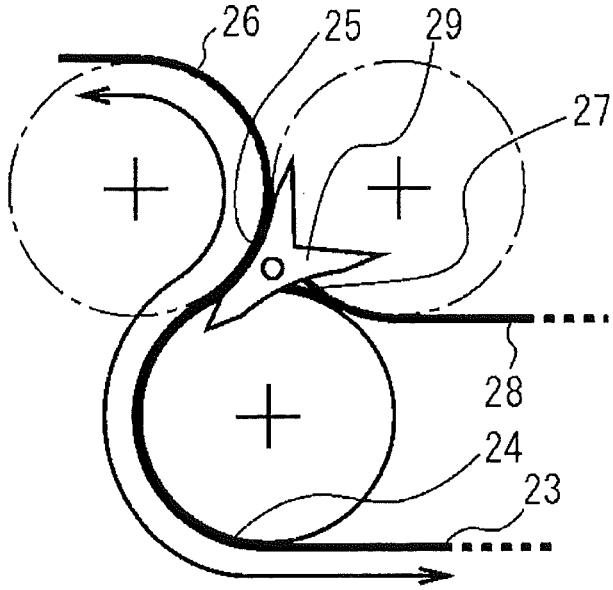
FIG. 6B is a rough line drawing that provides an explanation of switching of the conveying path by the switching blades.
Figure 6C:
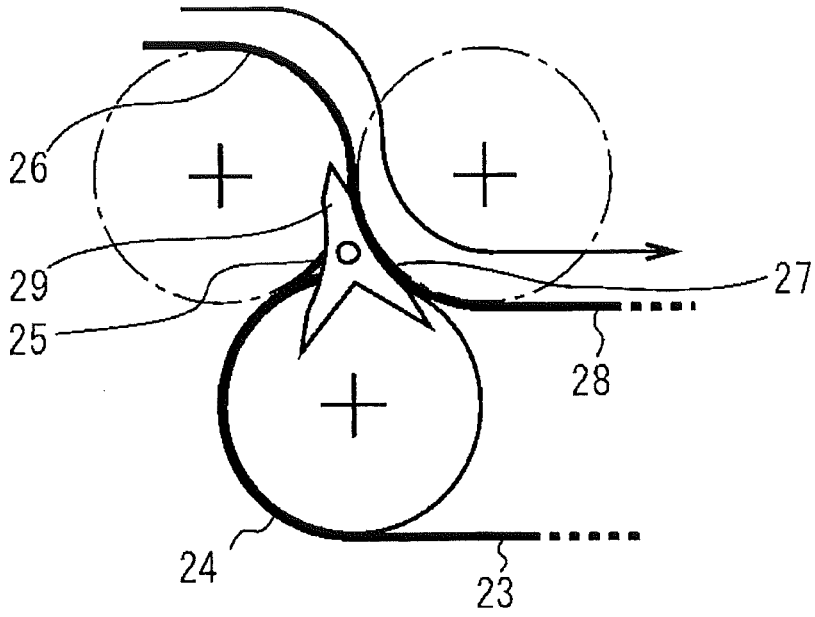
FIG. 6C is a rough line drawing that provides an explanation of switching of the conveying path by the switching blades.

Due thereto, as shown in FIG. 6A through FIG. 6C, when the switching blade 29A of the switching portion 29 is appropriately rotated and one of the two arc-shaped cut-out portions 29AY, 29AZ is made to go along the region between the two connection positions of one of the arc-shaped conveying paths, the bill that is conveyed via that one or another arc-shaped conveying path can be guided to the other or the one arc-shaped conveying path without the conveying direction being changed suddenly.

Namely, by the switching blades 29A, the switching portion 29 guides a bill from one arc-shaped conveying path to another arc-shaped conveying path, and can convey the bill so as to draw a gradual backward S-shape overall.

Due to the switching portion 29 rotating the switching blades 29A in the conveying path surrounded space in this way, the conveying path that is used in the conveying of the bill together with the first arc-shaped conveying path 24 can be easily and reliably switched to either the second arc-shaped conveying path 25 and the third arc-shaped conveying path 26, or to the fifth arc-shaped conveying path 28.

Further, due to the switching portion 29 rotating the switching blades 29A in the conveying path surrounded space, the conveying path that is used in the conveying of the bill together with the third arc-shaped conveying path 26 can be easily and reliably switched to either the second arc-shaped conveying path 25 and the first arc-shaped conveying path 24, or to the fourth arc-shaped conveying path 27 and the fifth arc-shaped conveying path 28.

A control section 30 having a microcomputer structure for example is provided within the automatic teller machine 1. The control section 30 operates the above-described bill insertion/take-out section 6, discriminating section 10, temporary storage section 11, switching portions 18, 29, lower unit 12, and plural conveying paths in accordance with the depositing and discharging of bills, by generally controlling the entire automatic teller machine 1.

Note that, at the automatic teller machine 1, at both the time of depositing and the time of dispensing a bill, the bill is conveyed via the above-described plural conveying paths with one long side of the bill facing the conveying direction (i.e., the short side direction of the bill being substantially parallel to the conveying direction).

Due thereto, at the time of a deposit of bills, when bills are placed on the placement stand 6A within the bill insertion/take-out section 6 (i.e., when bills are inserted into the bill insertion/take-out section 6), the control section 30 moves the partitioning plate 6D in the forward direction and pushes the bills on the placement stand 6A against the wall at the front side so as to line them up uniformly.

In this state, the control section 30 separates the bills on the placement stand 6A one-by-one by the separation/draw-out mechanism 6B, and successively draws them out to the lower side of the bill insertion/take-out section 6.

At this time, the control device 30 carries out switching by the switching portion 18 so as to use the front side conveying path 16 in the conveying of the bills ahead of the draw-out side conveying path 15.

Accordingly, the control section 30 conveys, via the draw-out side conveying path 15, the bills that are drawn-out one-by-one from the bill insertion/take-out section 6, and in continuation thereafter, conveys the bills via the front side conveying path 16 to the discriminating section 10 due to the switching of the conveying path by the switching portion 18.

Then, while the discriminating section 10 takes the bills, which have been conveyed from the bill insertion/take-out section 6 in this way, into the interior one-by-one via the discrimination front side take-in/discharge opening, the discriminating section 10 discriminates the denomination, the state and the like of the bills, and thereafter, draws the bills out one-by-one from the discrimination rear side take-in/discharge opening.

Due thereto, the control section 30 conveys the bills, which are drawn-out one-by-one from the discriminating section 10 in this way, to the first arc-shaped conveying path 24 via the rear side conveying path 23.

Here, when the control section 30 conveys, via the rear side conveying path 23, the bills that have been discriminated as being normal and have been drawn-out from the discriminating section 10, the control section 30 carries out switching by the switching portion 29 so as to, from midway along the first arc-shaped conveying path 24, use the second arc-shaped conveying path 25 in the conveying of the bills instead of the first arc-shaped conveying path 24.

Accordingly, at the time when a bill that is normal is conveyed from the rear side conveying path 23 to midway along the first arc-shaped conveying path 24, due to the switching of the conveying path by the switching portion 29, the control section 30 conveys the bill in continuation via the second arc-shaped conveying path 25 and the third arc-shaped conveying path 26 successively to the temporary holding section 11.

Then, the temporary holding section 11 takes-in one-by-one and holds, in the interior thereof and via the take-in/draw-out mechanism 11A, the bills that are conveyed from the discriminating section 10 in this way. Due thereto, the control section 30 temporarily holds the deposit of bills.

However, when, among the bills that are discriminated by the discriminating section 10, there exists a bill that is discriminated as being abnormal, at the time when that bill that is discriminated as being abnormal is conveyed via the rear side conveying path 23, the control section 30 carries out switching by the switching portion 29 so as to use the first arc-shaped conveying path 24 and the fifth arc-shaped conveying path 28 in the conveying of the bill ahead of the rear side conveying path 23.

Accordingly, a bill that is discriminated as being abnormal is conveyed from the rear side conveying path 23 up to midway along the first arc-shaped conveying path 24, and in continuation thereafter, due to the switching of the conveying path by the switching portion 29, is conveyed via the remaining portion of the first arc-shaped conveying path 24, and is further conveyed via the fifth arc-shaped conveying path 28 to the bill insertion/take-out section 6.

Note that the automatic teller machine 1 refuses to handle bills that are discriminated as abnormal by the discriminating section 10, and hereinafter, such bills are also called rejected bills in particular.

Then, by the take-in/stacking mechanism 6C, the control section 30 takes the rejected bill into the bill insertion/take-out section 6, and places it on the placement stand 6D.

Note that, at this time, the control section 30 prevents disorder of the bills on the placement stand 6A by moving the partitioning plate 6D in the rearward direction and appropriately narrowing the space for the taking-in of bills.

In this way, when all of the bills that were inserted into the bill insertion/take-out section 6 are discriminated at the discriminating section 10, if there is a rejected bill, the control section 30 returns this rejected bill to the customer via the bill insertion/take-out section 6.

Further, the control section 30 computes the total amount of the bills reserved as the deposit, from the denominations of the bills that were discriminated as normal by the discriminating section 10 at this time. Then, the control section 30 provides this computed total amount to the customer via an operation image that is displayed on the touch screen 4.

As a result, when the customer touch-operates the surface of the touch screen 4 and confirms the amount of the deposit, the control section 30 carries out switching by the switching portion 29 so as to use the second arc-shaped conveying path 25 and the first arc-shaped conveying path 24 in the conveying of the bills ahead of the third arc-shaped conveying path 26.

In this state, the temporary holding section 11, by the take-in/draw-out mechanism 11A, separates and draws-out one-by-one the bills held within the temporary holding section 11.

Due thereto, the control section 30 conveys the bills, that were drawn-out one-by-one from the temporary holding section 11, via the third arc-shaped conveying path 26, and in continuation thereafter, due to the switching of the conveying path by the switching portion 29, conveys the bills again via the second arc-shaped conveying path 25, a portion of the first arc-shaped conveying path 24, and the rear side conveying path 23 successively, to the discriminating section 10.

Then, while the discriminating section 10 takes the bills, which were conveyed from the temporary holding section 11 in this way, one-by-one into the interior via the discrimination rear side take-in/discharge opening, the discriminating section 10 again discriminates the denominations, states and the like of these bills, and thereafter, draws the bills out one-by-one from the discrimination front side take-in/discharge opening.

At this time, the control section 30 carries out switching by the switching portion 18 so as to use the unit side conveying path 17 in the conveying of bills ahead of the front side conveying path 16.

Accordingly, the control section 30 conveys the bills, which were drawn-out from the discriminating section 10, one-by-one via the front side conveying path 16, and in continuation thereafter, due to the switching of the conveying path by the switching portion 18, conveys the bills via the unit side conveying path 17 to the lower unit 12.

Due thereto, via the distribution conveying path 13 at the lower unit 12, the control section 30 stores the bills, which were deposited by the customer, in the bill storage cassettes corresponding to the discriminated denominations.

By the way, when, at the time of this deposit, the control section 30 provides the customer with the total amount of the bills reserved as the deposit and, as a result, the customer touch-operates the surface of the touch screen 4 and instructs cancellation of the deposit, the control section 30 carries out switching, by the switching portion 29, such that the fourth arc-shaped conveying path 27 and the fifth arc-shaped conveying path 28 are used in the conveying of the bills ahead of the third arc-shaped conveying path 26.

In this state, the temporary holding section 11 separates and draws-out, one-by-one and by the take-in/draw-out mechanism 11A, the bills that are held within the temporary holding section 11.

Accordingly, the control section 30 conveys the bills, which are drawn-out one-by-one from the temporary holding section 11, via the third arc-shaped conveying path 26, and in continuation thereafter, by switching the conveying path by the switching portion 29, conveys the bills to the bill insertion/take-out section 6 via the fourth arc-shaped conveying path 27 and the fifth arc-shaped conveying path 28 successively.

Due thereto, by the take-in/stacking mechanism 6C, the control section 30 takes the bills into the bill insertion/take-out section 6 and places them on the placement stand 6D, and returns these bills to the customer via the bill insertion/take-out section 6.

On the other hand, at the time of dispensing bills, when a customer touch-operates the surface of the touch screen 4 and designates an amount of money that can be dispensed from that customer's account, the control section 30 carries out switching by the switching portion 18 so as to use the front side conveying path 16 for the conveying of bills ahead of the unit side conveying path 17.

In this state, the control section 30 draws-out, one-by-one from the bill storage cassettes at the lower unit 12, bills in the monetary amount designated by the customer.

Accordingly, the control section 30 conveys the bills, which are drawn-out from the bill storage cassettes, one-by-one via the distribution conveying path 13 and the unit side conveying path 17 successively, and in continuation thereafter, conveys the bills to the discriminating section 10 via the front side conveying path 16 due to the switching of the conveying path by the switching portion 18.

While the discriminating section 10 takes-in the bills, which were conveyed from the bill storage cassettes of the lower unit 12 in this way, one-by-one into the interior thereof via the discrimination front side take-in/discharge opening, the discriminating section 10 discriminates the denominations, states and the like of these bills, and thereafter, draws the bills out one-by-one from the discrimination rear side take-in/discharge opening.

Due thereto, the control section 30 conveys the bills, which are drawn-out one-by-one from the discriminating section 10 in this way, via the rear side conveying path 23 to the first arc-shaped conveying path 24.

Here, when the control section 30 conveys, via the rear side conveying path 23, bills that were discriminated as normal by the discriminating section 10 and drawn-out therefrom, the control section 30 carries out switching by the switching portion 29 such that the first arc-shaped conveying path 24 and the fifth arc-shaped conveying path 28 are used in the conveying of the bills ahead of the rear side conveying path 23.

Accordingly, the control section 30 conveys the bills, which were discriminated as being normal, from the rear side conveying path 23 to midway along the first arc-shaped conveying path 24, and in continuation thereafter, due to the switching of the conveying path by the switching portion 29, conveys the bills via the remaining portion of the first arc-shaped conveying path 24, and further conveys the bills via the fifth arc-shaped conveying path 28 to the bill insertion/take-out section 6.

Then, by the take-in/stacking mechanism 6C, the control section 30 takes the bills into the bill insertion/take-out section 6 and places them on the placement stand 6D, and hands these bills over to the customer via the bill insertion/take-out section 6.

However, when rejected bills exist among the bills discriminated by the discriminating section 10, at the time when these rejected bills are conveyed via the rear side conveying path 23, the control section 30 carries out switching by the switching portion 29 so as to use the second arc-shaped conveying path 25 and the third arc-shaped conveying path 26 in the conveying of the bills ahead of the rear side conveying path 23.

Accordingly, at the time when the rejected bills are conveyed from the rear side conveying path 23 to midway along the first arc-shaped conveying path 24, the control section 30 conveys the rejected bills in continuation to the temporary holding section 11 via the second arc-shaped conveying path 25 and the third arc-shaped conveying path 26 successively, due to the switching of the conveying path by the switching portion 29.

Then, the temporary holding section 11 takes-in and holds, in the interior thereof and one-by-one via the take-in/draw-out mechanism 11A, the bills that are conveyed from the discriminating section 10 in this way.

When rejected bills are held in the temporary holding section 11 during a dispensing operation in this way, after the dispensing is completed (i.e., after bills have been handed over to the customer), the control section 30 carries out switching by the switching portion 29 so as to use the second arc-shaped conveying path 25 and the first arc-shaped conveying path 24 in the conveying of the bills ahead of the third arc-shaped conveying path 26.

In this state, the temporary holding section 11 separates and draws-out, one-by-one and by the take-in/draw-out mechanism 11A, the rejected bills that are held in the temporary holding section 11.

Due thereto, the control section 30 conveys, via the third arc-shaped conveying path 26, the rejected bills that are drawn-out one-by-one from the temporary holding section 11, and, in continuation thereafter, due to the switching of the conveying path by the switching portion 29, conveys the bills to the discriminating section 10 again via the second arc-shaped conveying path 25, a portion of the first arc-shaped conveying path 24, and the rear side conveying path 23 successively.

Then, while the discriminating section 10 takes the rejected bills, which were conveyed from the temporary holding section 11 in this way, into the interior thereof one-by-one via the discrimination rear side take-in/discharge opening, the discriminating section 10 again discriminates the denominations, states and the like of these rejected bills, and thereafter, draws the bills out one-by-one from the discrimination front side take-in/discharge opening.

At this time, the control section 30 carries out switching by the switching portion 18 such that the unit side conveying path 17 is used in the conveying of the bills ahead of the front side conveying path 16.

Accordingly, the control section 30 conveys, one-by-one and via the front side conveying path 16, the rejected bills that were drawn-out from the discriminating section 10, and in continuation thereafter, conveys these bills to the lower unit 12 via the unit side conveying path 17, due to the switching of the conveying path by the switching portion 18.

Due thereto, the control section 30 stores the rejected bills in the corresponding bill storage cassettes via the distribution conveying path 13 at the lower unit 12.

In this way, the control section 30 can carry out the transaction of the deposit or dispensing of bills that the customer desires, by conveying the bills via the conveying paths between the respective sections in accordance with the depositing or the dispensing of the bills.

(1-3) Operation and Effects of First Exemplary Embodiment

In the above-described structure, at the automatic teller machine 1, partial segments of three conveying paths that are the discriminating side conveying path 20, the holding side conveying path 21 and the insertion/take-out side conveying path 22, which are for connecting together the discriminating section 10, the temporary holding section 11 and the bill insertion/take-out section 6 at the bill conveying section 19, are formed in arc shapes.

Further, at the automatic teller machine 1, between the discriminating section 10, the temporary holding section 11 and the bill insertion/take-out section 6, the discriminating side conveying path 20, the holding side conveying path 21 and the insertion/take-out side conveying path 22 are disposed with two connection positions of the respective arc-shaped segments thereof being connected to the respectively different discriminating side conveying path 20, holding side conveying path 21 and insertion/take-out side conveying path 22, such that the outer sides of the arcs thereof face one another.

At the automatic teller machine 1, the switching portion 29 is disposed at the places of connection of the discriminating side conveying path 20, the holding side conveying path 21 and the insertion/take-out side conveying path 22.

Further, when bills are conveyed from the discriminating section 10 to the temporary holding section 11 or the bill insertion/take-out section 6, the automatic teller machine 1 guides the bills, which are conveyed via the discriminating side conveying path 20, to the other holding side conveying path 21 or insertion/take-out side conveying path 22 and switches the path that is used in the conveying of the bills, by the switching portion 29.

Moreover, when bills are conveyed from the temporary holding section 11 to the discriminating section 10 or the bill insertion/take-out section 6, the automatic teller machine 1 guides the bills, which are conveyed via the holding side conveying path 21, to the other discriminating side conveying path 20 or insertion/take-out side conveying path 22 and switches the path that is used in the conveying of the bills, by the switching portion 29.

Accordingly, at the automatic teller machine 1, when the automatic teller machine 1 conveys bills from the discriminating section 10 to the temporary holding section 11 or the bill insertion/take-out section 6, or conveys bills from the temporary holding section 11 to the discriminating section 10 or the bill insertion/take-out section 6, even though the conveying path that is used in the conveying of the bills is switched at the places of connection of the discriminating side conveying path 20, the holding side conveying path 21 and the insertion/take-out side conveying path 22, to any of these conveying paths, the conveying direction can be prevented from changing suddenly when the bills pass through the places of connection, and the occurrence of jamming can be greatly reduced.

In accordance with the above-described structure, at the automatic teller machine 1, partial segments of three conveying paths that are the discriminating side conveying path 20, the holding side conveying path 21 and the insertion/take-out side conveying path 22, which are for connecting together the discriminating section 10, the temporary holding section 11 and the bill insertion/take-out section 6, are formed in arc shapes. The discriminating side conveying path 20, the holding side conveying path 21 and the insertion/take-out side conveying path 22 are disposed with two positions of the respective arc-shaped segments thereof being connected to the respectively different discriminating side conveying path 20, holding side conveying path 21 and insertion/take-out side conveying path 22, such that the outer sides of the arcs thereof face one another. Further, the switching portion 29 is disposed at these places of connection, and when bills are conveyed between the discriminating section 10, the temporary holding section 11 and the bill insertion/take-out section 6, the conveying path that is used in the conveying of the bills is switched by the switching portion 29 at the places of connection of the discriminating side conveying path 20, the holding side conveying path 21 and the insertion/take-out side conveying path 22.

Due thereto, at the automatic teller machine 1, even when bills are conveyed by switching from any of the discriminating side conveying path 20, the holding side conveying path 21 and the insertion/take-out side conveying path 22 to any other of the discriminating side conveying path 20, the holding side conveying path 21 and the insertion/take-out side conveying path 22 at the places of connection of the discriminating side conveying path 20, the holding side conveying path 21 and the insertion/take-out side conveying path 22, the conveying direction can be prevented from changing suddenly when the bills pass through the places of connection, and the occurrence of jamming can be greatly reduced. Accordingly, the automatic teller machine 1 can prevent a decrease in the conveying efficiency of bills.

Here, among the bills that the automatic teller machine 1 handles, there bills that are in a good state such as new bills or bills in a state that is about the same as that of new bills. However, there are also bills whose state is not good, such as bills that have become creased due to handling by customers or the like, bills that have curled-up, bills that are torn, bills lacking tautness (lacking stiffness), and the like.

The bills that the automatic teller machine 1 handles at the time of dispersals are mainly bills that are in good states such as new bills that have been loaded into the bill storage cassettes by bank workers or the like, and the bills accommodated in the bill storage cassettes after, for example, bills that are in states too poor to serve as bills to be ejected have been removed from among the bills deposited by customers.

In contrast, because the bills that the automatic teller machine 1 handles at the time of deposits are bills that customers have inserted, there is the tendency for there to be many bills that are not in good state as compared with the bills that are handled at the time of dispersals.

In a structure in which plural conveying paths, which are used in the conveying of bills, are connected such that the conveying direction of the bills is changed suddenly, jams tend to arise more easily when bills that are in poor states are conveyed than when bills that are in good state, such as new bills, are conveyed.

Therefore, in a structure in which conveying paths, which are used in the conveying of bills, are connected such that the conveying direction of the bills is changed suddenly, jams tend to arise more easily at times of deposits than at times of dispersals.

However, in accordance with the automatic teller machine 1 in accordance with the first exemplary embodiment, the discriminating side conveying path 20, the holding side conveying path 21 and the insertion/take-out side conveying path 22, at which partial segments thereof are formed in arc shapes as described above, are disposed so as to be connected.

Accordingly, at the automatic teller machine 1, at the time of a deposit, even when bills are conveyed by switching from any of the discriminating side conveying path 20, the holding side conveying path 21 and the insertion/take-out side conveying path 22 to any other of the discriminating side conveying path 20, the holding side conveying path 21 and the insertion/take-out side conveying path 22, the conveying direction at the time when a bill passes through the places of connection thereof is prevented from changing suddenly, and the occurrence of jams is greatly reduced, and a decrease in the conveying efficiency of the bills can be prevented.

Further, in the automatic teller machine 1, the respective arc-shaped segments of the discriminating side conveying path 20, the holding side conveying path 21 and the insertion/take-out side conveying path 22 are formed on the basis of circumferences of circles having the same radius, and the discriminating side conveying path 20, the holding side conveying path 21 and the insertion/take-out side conveying path 22 are disposed so as to be connected at two connection positions of the arc-shaped segments such that the outer sides of the arcs thereof face one another.

Accordingly, at the automatic teller machine 1, the conveying path surrounded space can be formed in a substantially equilateral triangular shape. Moreover, the switching portion 29, that has the substantially wedge-shaped switching blades 29A at whose one and other side surface the arc-shaped cut-out portions 29AY, 29AZ are respectively formed, is disposed at the central portion of this conveying path surrounded space at the automatic teller machine 1.

Accordingly, at the automatic teller machine 1, the one side surface side and the other side surface side are formed in the simple shape of having line symmetry with respect to the imaginary line L1 that passes from the distal end of the switching blade 29A through the center of the hole portion 29AX, and, due to these switching blades 29A rotating, the conveying path that is used in the conveying of bills can be easily and reliably switched to any of the discriminating side conveying path 20, the holding side conveying path 21 and the insertion/take-out side conveying path 22.

(2) Second Exemplary Embodiment

(2-1) Internal Structure of Automatic Teller Machine

Figure 7:
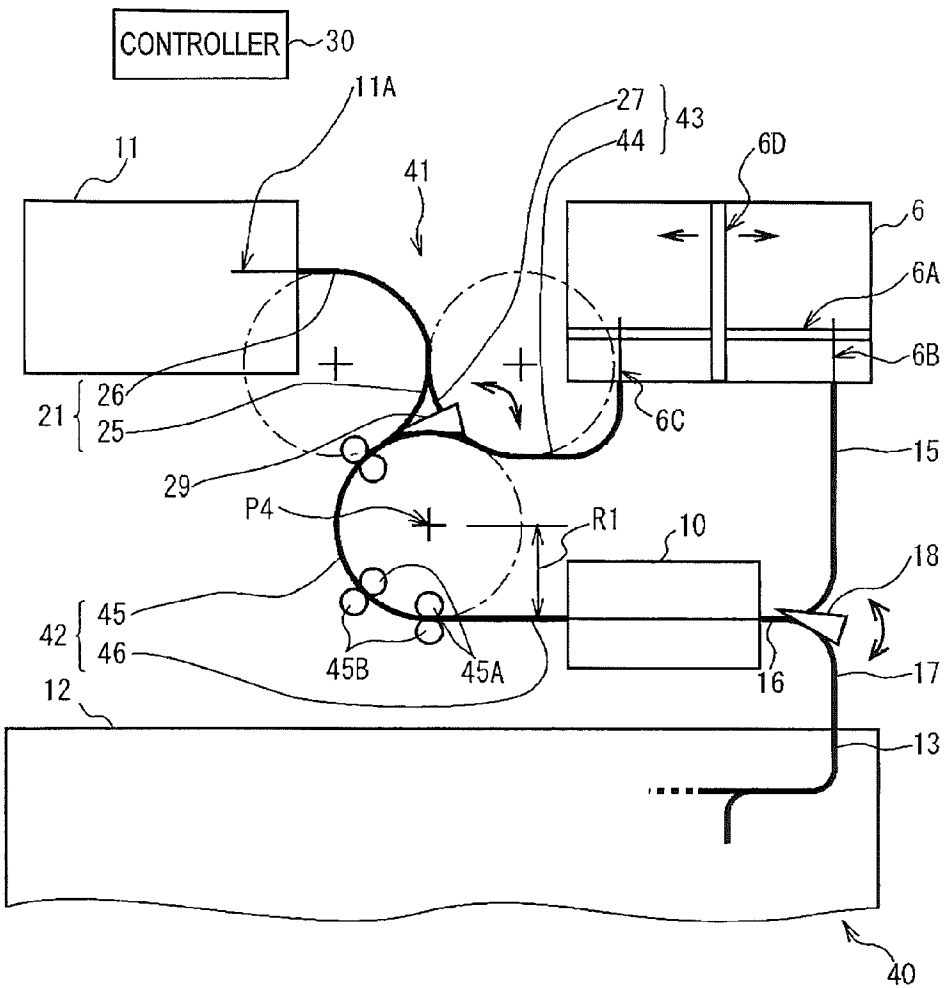
FIG. 7 is a rough line drawing showing the internal structure of an automatic teller machine in accordance with a second exemplary embodiment.

The internal structure of an automatic teller machine 40 in accordance with a second exemplary embodiment is described next by using FIG. 7 in which portions corresponding to FIG. 2 are denoted by the same reference numerals as in FIG. 2.

This automatic teller machine 40 is structured similarly to the automatic teller machine 1 according to the above-described first exemplary embodiment, except for the structures of a discriminating side conveying path 42 at a bill conveying section 41, and a fifth arc-shaped conveying path 44 of an insertion/take-out side conveying path 43.

In this case, a first arc-shaped conveying path 45 of the discriminating side conveying path 42 is formed by using, as a reference, the circumference of a circle that has the first radius R1 and at which a position, which is separated by a length corresponding to the first radius R1 directly upward from the other end of a rear side conveying path 46, is a center (hereinafter also called fourth center) P4.

Namely, given that, on this circumference, the intersection point with an imaginary line, which extends directly downward from the fourth center P4, is one end, and the intersection point with an imaginary line, which extends from the fourth center P4 in a direction inclined 30° toward the front side with respect to directly above the fourth center P4, is another end, the first arc-shaped conveying path 45 is formed so as to convey a bill along the arc between the one end and the other end (i.e., in an arc shape).

Further, a conveying driving section that has plural drive shafts (not illustrated), plural drive rollers 45A having a radius smaller than the first radius R1, plural tension shafts (not illustrated), plural tension rollers 45B, a pair of conveying guides (not illustrated), plural motors (not illustrated), and the like, is provided at the first arc-shaped conveying path 45 in order to convey bills.

In this case, the plural drive shafts are supported so as to be rotatable in one direction and in the other direction in a posture of being parallel to the leftward direction respectively, at predetermined intervals at the inner side of the arc in a range from the one end to the other end of the first arc-shaped conveying path 45. Respective one ends of the plural drive shafts are connected to driving shafts of the motors.

Hole portions (not illustrated) are formed in the respective centers of the plural drive rollers 45A, and a predetermined number of the drive rollers 45A are mounted at predetermined intervals to each drive shaft via the hole portions.

Accordingly, due to the conveying driving section driving and rotating the plural drive shafts via the motors, the plural drive rollers 45A that are mounted to these drive shafts can be rotated in one direction and the other direction around the plural drive shafts.

Further, the plural tension shafts are supported so as to be rotatable in one direction and in the other direction in a posture of being parallel to the leftward direction respectively at the outer side of the arc so as to oppose, on normal lines that extend from the fourth center P4, the drive shafts at the inner side of the arc in the range from the one end to the other end of the first arc-shaped conveying path 45. The plural tension shafts are urged in the direction of the fourth center P4 respectively.

The plural tension rollers 45B respectively have radii that are equal to, for example, the radii of the plural drive rollers 45A, and hole portions (not illustrated) are formed in the centers of the tension rollers 45B.

Further, the plural tension rollers 45B are mounted at predetermined intervals (i.e., so as to face the drive rollers 45A) to each tension shaft via the hole portions, in the same number as the number of the drive rollers 45A that are mounted to one drive shaft.

Accordingly, by the urging of the plural tension shafts respectively, the conveying driving section can push the peripheral side surfaces of the plural tension rollers 45B against the peripheral side surfaces of the drive rollers 45A facing them respectively.

Accordingly, when the conveying driving section rotates the plural drive rollers 45A in the one direction and the other direction, interlockingly therewith, the plural tension rollers 45B can be rotated around the tension shafts in the other direction and one direction opposite the drive rollers 45A.

Further, one of the pair of conveying guides is formed in a substantial arc shape that goes along the circumference of a circle whose radius is slightly larger than the first radius R1 for example. Hole portions, which pass through from the outer surface to the inner surface, are formed in this conveying guide in correspondence with the positions where the plural tension rollers 45B are disposed.

The corresponding tension rollers 45B are inserted respectively into the plural hole portions of the one conveying guide, and the one conveying guide is disposed, for example, so as to extend from a vicinity of the one end of the first arc-shaped conveying path 45 to a vicinity of the position of connection with the second arc-shaped conveying path 25, and such that the inner surface of the one conveying guide is adjacent to the peripheral side surfaces of the drive rollers 45A.

Further, the other one of the pair of conveying guides is formed in a substantial arc shape that goes along the circumference of a circle whose radius is slightly smaller than the first radius R1 for example Hole portions, which pass through from the outer surface to the inner surface, are formed in this other conveying guide in correspondence with the positions where the plural drive rollers 45A are disposed.

The corresponding drive rollers 45A are inserted respectively into the plural hole portions of this other conveying guide, and this other conveying guide is disposed, for example, so as to extend from a vicinity of the one end of the first arc-shaped conveying path 45 to a vicinity of the position of connection with the second arc-shaped conveying path 25, and such that the inner surface of this other conveying guide is adjacent to the peripheral side surfaces of the tension rollers 45B (i.e., the inner surface of the one conveying guide).

On the basis of this structure, when bills are conveyed via the rear side conveying path 46, the conveying driving section of the first arc-shaped conveying path 45 respectively rotates, in one direction, a predetermined number of the drive rollers 45A that are disposed in order along the arc.

Due thereto, the conveying driving section of the first arc-shaped conveying path 45 takes-in bills from the one end side so as to successively nip the bills in between the plural drive rollers 45A and the plural tension rollers 45B, and, on the other hand, pushes the bills out at the other end side and can convey the bills to the second arc-shaped conveying path 25 or the fifth arc-shaped conveying path 44.

Further, when bills are conveyed via the second arc-shaped conveying path 25, the conveying driving section of the first arc-shaped conveying path 45 respectively rotates, in the other direction, a predetermined number of the drive rollers 45A that are disposed in order along the arc.

Due thereto, the conveying driving section of the first arc-shaped conveying path 45 takes-in bills from the other end side so as to successively nip the bills in between the plural drive rollers 45A and the plural tension rollers 45B, and, on the other hand, pushes the bills out at the one end side and can convey the bills to the rear side conveying path 46.

Further, in the same way as the first arc-shaped conveying path 24 in accordance with the above-described first exemplary embodiment, the first arc-shaped conveying path 45 is formed by using the first radius R1 as a reference. Therefore, the conveying driving section of the first arc-shaped conveying path 45 conveys bills along a relatively gradual arc.

Accordingly, at the conveying driving section of the first arc-shaped conveying path 45, the centrifugal force that is applied to the bill that is being conveyed is made to be as small as possible, and floating-up of the bill from the peripheral side surfaces of the plural drive rollers 45A is greatly reduced.

Further, even if the bill starts to float up, the conveying driving section of the first arc-shaped conveying path 45 pushes the bill to return toward the side of the drive rollers 45A by the inner surface of the conveying guide that is adjacent to the peripheral side surfaces of the plural drive rollers 45A, and can guide the bill between the plural drive rollers 45A and the plural tension rollers 45B.

Due to the pair of conveying guides being disposed so as to be adjacent to one another, the conveying driving section of the first arc-shaped conveying path 45 guides and conveys the bill that is being conveyed such that, for example, the bill does not catch on the gears that are for connecting the drive shafts and the motors, or the like.

Moreover, at the conveying driving section of the first arc-shaped conveying path 45, the interval at which the plural drive shafts and tension shafts are placed is appropriately set to be, for example, less than or equal to ½ of the length in the short-side direction of the bill that is the object of conveying, and the number of tension shafts as well is set appropriately in accordance with that placement interval and the length of the arc of the first arc-shaped conveying path 45.

Accordingly, when the conveying driving section of the first arc-shaped conveying path 45 pushes one long-side side end portion of the conveyed bill out from between the drive rollers 45A and the tension rollers 45B, the bill can be nipped-in by the next drive rollers 45A and tension rollers 45B with the long-side side end portion of the bill hardly floating-up at all.

In this way, in the same way as the first arc-shaped conveying path 24 in accordance with the above-described first exemplary embodiment, the conveying driving section of the first arc-shaped conveying path 45 as well can convey the bill along an arc without the bill catching on the plural tension rollers 45B or the gears for connecting the drive shafts and the motors, or the like.

Further, in the automatic teller machine 40, due to the structure relating to the first arc-shaped conveying path 45, no structural part, which protrudes out further toward the front side than the one end and the other end, exists at the first arc-shaped conveying path 45. Therefore, the one end side horizontal portion, which is from the one end to the bent portion of the fifth arc-shaped conveying path 44, is formed to be shorter than in the case of the fifth arc-shaped conveying path 28 (FIG. 2 and FIG. 3) in accordance with the first exemplary embodiment.

Moreover, at the automatic teller machine 40, in accordance with the structure relating to the first arc-shaped conveying path 45, the rear side conveying path 46 as well is overall formed to be shorter than the rear side conveying path 23 of the first exemplary embodiment.

Due thereto, at the automatic teller machine 40, the first arc-shaped conveying path 45, the second arc-shaped conveying path 25, the third arc-shaped conveying path 26, the fourth arc-shaped conveying path 27 and the fifth arc-shaped conveying path 44 can, together with the temporary holding section 11, be disposed so as to be closer to the bill insertion/take-out section 6 than in the case of first exemplary embodiment.

(2-2) Operation and Effects of Second Exemplary Embodiment

In accordance with the above-described structure, at the automatic teller machine 40, the discriminating side conveying path 42, the holding side conveying path 21 and the insertion/take-out side conveying path 43 at the bill conveying section 41 are structured basically similarly to the case of the above-described first exemplary embodiment.

However, at the automatic teller machine 40, the first arc-shaped conveying path 45 is formed such that the plural sets of drive rollers 45A and the plural sets of tension rollers 45B that push against them are disposed successively at predetermined intervals from one end to the other end.

Accordingly, at the automatic teller machine 40, the temporary holding section 11, together with the discriminating side conveying path 42, the holding side conveying path 21 and the insertion/take-out side conveying path 43, can be disposed so as to be closer to the bill insertion/take-out section 6 than in the case of the first exemplary embodiment.

Due to the above-described structure, at the automatic teller machine 40, the first arc-shaped conveying path 45 is formed such that the plural sets of drive rollers 45A and the plural sets of tension rollers 45B that push against them are disposed successively at predetermined intervals from one end to the other end.

Due thereto, the automatic teller machine 40 can exhibit effects that are similar to the effects obtained by the above-described first exemplary embodiment. Further, in addition thereto, the temporary holding section 11, together with the discriminating side conveying path 42, the holding side conveying path 21 and the insertion/take-out side conveying path 43, can be disposed closer to the bill insertion/take-out section 6 than in the case of the first exemplary embodiment, and therefore, the automatic teller machine 40 can be made to be compact.

Further, at the automatic teller machine 40, due to this structure, the number of structural parts of the fifth arc-shaped conveying path 44 and the rear side conveying path 46 can be reduced and the fifth arc-shaped conveying path 44 and the rear side conveying path 46 can be formed to be shorter than in the case of the first exemplary embodiment, and therefore, the structure of the automatic teller machine 40 can be simplified.

Moreover, at the automatic teller machine 40, the results of discrimination by the discriminating section 10 at times of deposits and at times of dispersals are reflected in the switching of the conveying paths by the switching portion 29.

Still further, if, for example, the length of the rear side conveying path 23 in the case of the above-described first exemplary embodiment is set to be longer than a shortest length that takes into consideration the bill conveying speed and the discrimination processing speed per bill by the discriminating section 10, the rear side conveying path 46 at the automatic teller machine 40 can, owing to the structure of the automatic teller machine 40, be formed to the shortest length that takes into consideration the bill conveying speed and the discrimination processing speed per bill by the discriminating section 10.

(3) Third Exemplary Embodiment

(3-1) Internal Structure of Automatic Teller Machine

Figure 8:
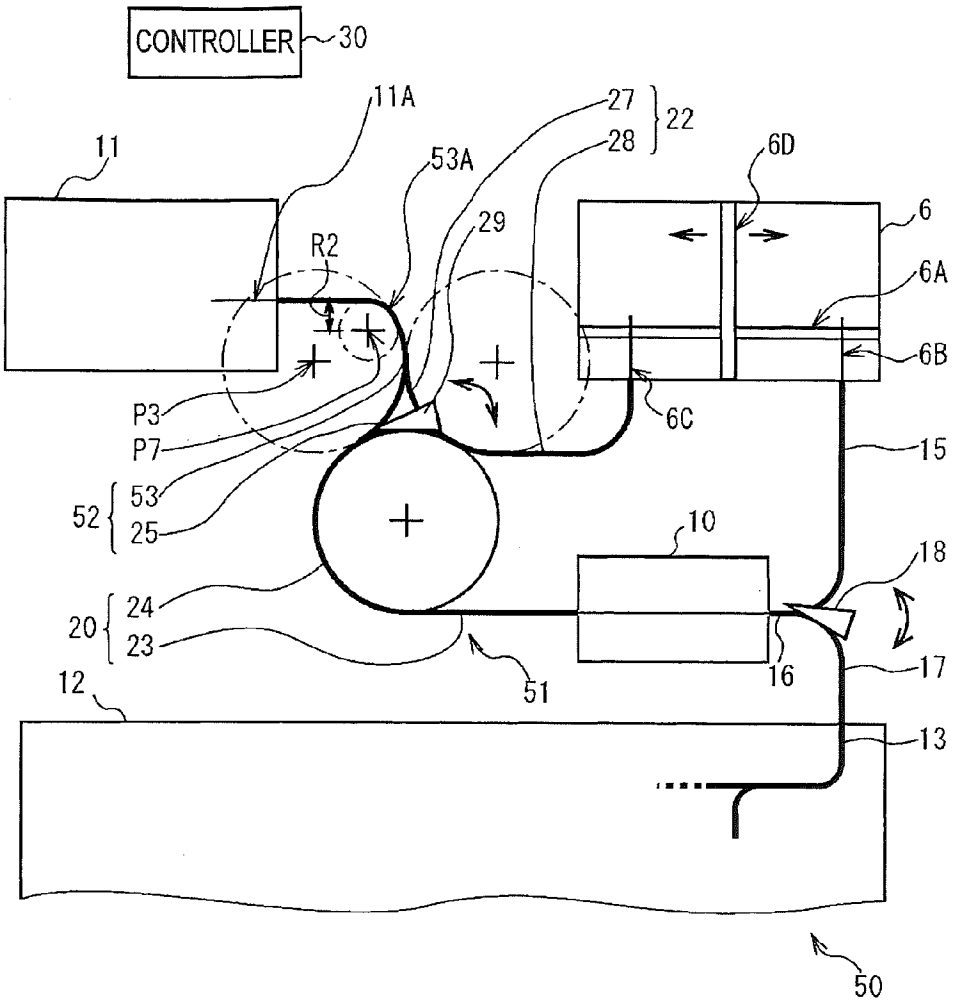
FIG. 8 is a rough line drawing showing the internal structure of an automatic teller machine in accordance with a third exemplary embodiment.

The internal structure of an automatic teller machine 50 in accordance with a third exemplary embodiment is described next by using FIG. 8 in which portions corresponding to FIG. 2 are denoted by the same reference numerals as in FIG. 2.

This automatic teller machine 50 is structured similarly to the automatic teller machine 1 according to the above-described first exemplary embodiment, except for the structure of a third arc-shaped conveying path 53 of a holding side conveying path 52 at a bill conveying section 51.

In this case, one end portion of the third arc-shaped conveying path 53 is formed in an arc shape by using, as a reference, the circumference of a circle that has the first radius R1 and whose center is the second center P2, in the same way as in the case of the first exemplary embodiment.

However, a central portion 53A of the third arc-shaped conveying path 53, which is between the one end portion and the other end side horizontal portion, is formed in an arc shape by using, as a reference, the circumference of a circle having a predetermined radius R2 that is smaller than the radius R1 and whose center is a predetermined position that is obliquely forward and upward of the second center P2, and such that that one end portion and other end side horizontal portion are connected with respective tangent lines thereof coinciding.

Note that a conveying driving section, which is basically structured similarly to the conveying driving section (FIG. 4) of the second arc-shaped conveying path 25 in accordance with the above-described first exemplary embodiment, is provided at the third arc-shaped conveying path 53.

Accordingly, in the same way as the conveying driving section of the second arc-shaped conveying path 25 in accordance with the above-described first exemplary embodiment, the conveying driving section 53 of the this third arc-shaped conveying path 53 also can convey a bill along an arc and the tangent line of the arc without the bill catching on gears for connecting the drive shafts and the motors, or the like.

(3-2) Operation and Effects of Third Exemplary Embodiment

In the above-described structure, at the automatic teller machine 50, the discriminating side conveying path 20 and the insertion/take-out side conveying path 22 at the bill conveying section 51 are structured similarly to the case of the above-described first exemplary embodiment.

However, at the automatic teller machine 50, the central portion 53A at the third arc-shaped conveying path 53 of the holding side conveying path 52 is formed in the shape of an arc whose reference is the circumference of a circle having the radius R2 that is smaller than the first radius R1 of the arc of the one end portion.

Accordingly, at the automatic teller machine 50, the third arc-shaped conveying path 53 can be made to be more compact than the third arc-shaped conveying path 26 in accordance with the above-described first exemplary embodiment, and further, the number of parts is reduced and the structure can be simplified.

In accordance with the above-described structure, at the automatic teller machine 50, the central portion 53A of the third arc-shaped conveying path 53 is formed in the shape of an arc whose reference is the circumference of a circle having the radius R2 that is smaller than the first radius R1 of the arc of the one end portion.

Due thereto, the automatic teller machine 50 can exhibit effects that are similar to the effects obtained by the above-described first exemplary embodiment. Further, in addition thereto, the third arc-shaped conveying path 53 can be made to be more compact than the third arc-shaped conveying path 26 in accordance with the above-described first exemplary embodiment, and further, the number of parts is reduced and the structure can be simplified. Therefore, the automatic teller machine 50 can be made to be compact and can be simplified.

(4) Fourth Exemplary Embodiment

(4-1) Internal Structure of Automatic Teller Machine

Figure 9:
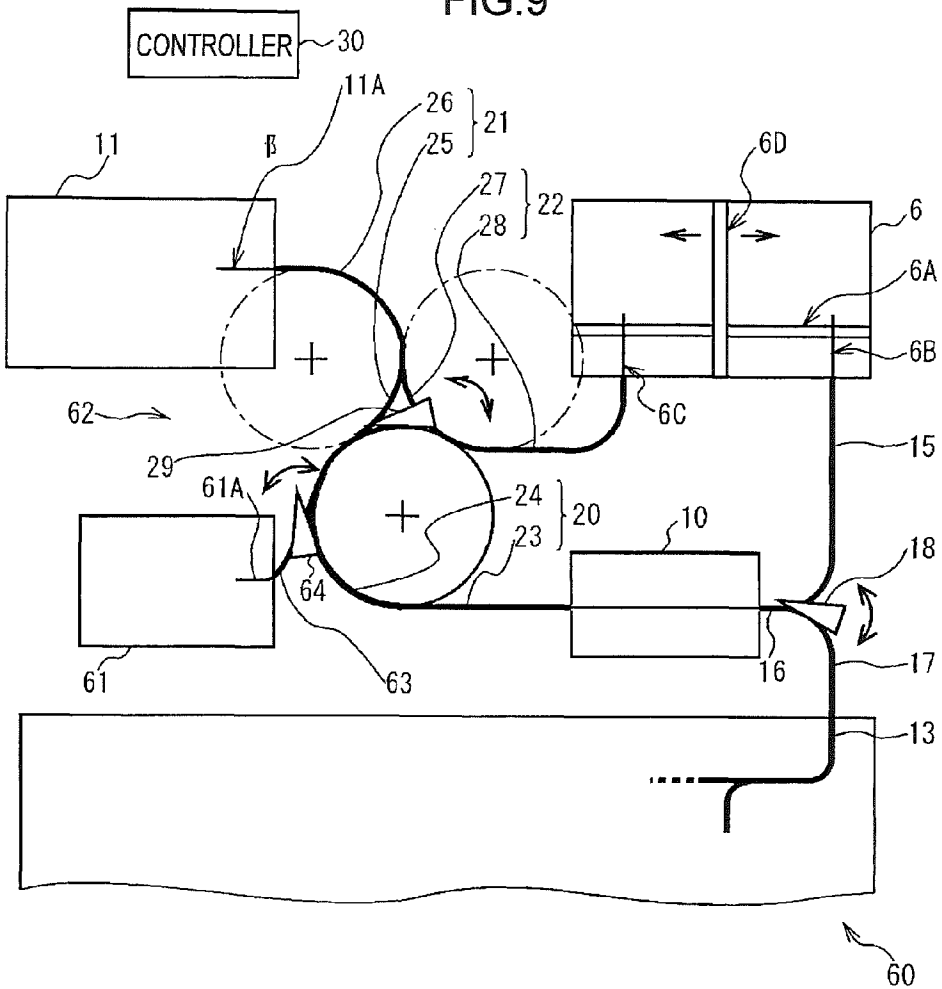
FIG. 9 is a rough line drawing showing the internal structure of an automatic teller machine in accordance with a fourth exemplary embodiment.

The internal structure of an automatic teller machine 60 in accordance with a fourth exemplary embodiment is described next by using FIG. 9 in which portions corresponding to FIG. 2 are denoted by the same reference numerals as in FIG. 2.

This automatic teller machine 60 is structured similarly to the automatic teller machine 1 according to the above-described first exemplary embodiment, except for the structures of a counterfeit bill storage cassette 61 that stores counterfeit notes (i.e., counterfeit bills) being provided between the temporary storage section 11 and the lower unit 12, and a conveying path 63, which connects this counterfeit bill storage cassette 61 and the first arc-shaped conveying path 24, being provided at a bill conveying section 62.

Note that, in the following description, the conveying path 63 that connects the counterfeit bill storage cassette 61 and the first arc-shaped conveying path 24, is also called the cassette side conveying path 63.

In this case, the counterfeit bill storage cassette 61 is provided so as to be able to be pulled-out to the exterior from the device housing 2 interior via a door portion that is provided at the device rear surface 2B of the device housing 2, and so as to be able to be accommodated from the exterior into the device housing 2.

A take-in mechanism 61A, which is for taking counterfeit bills one-by-one into the counterfeit bill storage cassette 61, is provided within the counterfeit bill storage cassette 61.

Further, the cassette side conveying path 63 is formed in a substantially rectilinear shape, and one end thereof is connected to the take-in end of the take-in mechanism 61A, and the other end thereof is connected to a predetermined connection position (hereinafter also called second connection position) of the first arc-shaped conveying path 24, and the cassette side conveying path 63 is disposed parallel to an obliquely rearward and downward direction.

A switching portion 64, for switching the conveying path that is used in conveying a bill, is disposed at the place of connection of the cassette side conveying path 63 and the first arc-shaped conveying path 24.

Due thereto, the switching portion 64 guides a bill, which was conveyed from the second arc-shaped conveying path 25 to the first arc-shaped conveying path 24 for example, selectively to the cassette side conveying path 63, and can switch the conveying path that is used in the conveying of the bill from the first arc-shaped conveying path 24 to the cassette side conveying path 63.

The other end portion of the cassette side conveying path 63 is formed so as to be rectilinear for example. Further, the other end of the cassette side conveying path 63 is connected to the second connection position of the first arc-shaped conveying path 24, such that the rectilinear other end portion coincides with the tangent line of this second connection position.

Accordingly, when the first arc-shaped conveying path 24 receives a bill that is conveyed via the second arc-shaped conveying path 25 for example, the first arc-shaped conveying path 24 can smoothly transfer this bill to the cassette side conveying path 63 without causing the bill to float-up excessively from the peripheral side surface of the drive roller 24A.

On the basis of this structure, while bills that were inserted into the bill insertion/take-out section 6 at the time of deposit are being discriminated at the discriminating section 10, the control section 30 carries out switching by the switching portion 64 such that the first arc-shaped conveying path 24 is used in the conveying of the bills also ahead of the second connection position at the first arc-shaped conveying path 24.

Further, even if the discriminating section 10 discriminates that a bill, among the bills that were inserted into the bill insertion/take-out section 6, is a counterfeit bill, that counterfeit bill can be drawn-out together with the other bills one-by-one from the discrimination rear side take-in/discharge opening.

Accordingly, regardless of whether the bills that are drawn-out one-by-one from the discriminating section 10 are counterfeit bills, the control section 30 conveys the bills via the rear side conveying path 23 to the second connection position of the first arc-shaped conveying path 24, and in continuation thereafter, due to the switching of the conveying path by the switching portion 64, conveys the bills to and holds them in the temporary holding section 11 via the first arc-shaped conveying path 24, the second arc-shaped conveying path 25 and the third arc-shaped conveying path 26 successively.

However, at this time, for the bills that were discriminated by the discriminating section 10 successively, the control section 30 stores bill discrimination information that expresses the order thereof from the first bill and the results of discrimination thereof, in an internal memory.

Then, when the total amount of the deposit is confirmed by the customer, the control section 30 carries out switching by the switching portion 29 so that the second arc-shaped conveying path 25 is used in conveying the bills ahead of the third arc-shaped conveying path 26.

In this state, the temporary holding section 11 separates and draws-out, one-by-one and by the take-in/draw-out mechanism 11A, the bills that are held within the temporary holding section 11.

Due thereto, the control section 30 conveys, via the third arc-shaped conveying path 26, the bills that were drawn-out one-by-one from the temporary holding section 11, and in continuation thereafter, conveys the bills via the second arc-shaped conveying path 25 to the first arc-shaped conveying path 24 due to the switching of the conveying path by the switching portion 29.

At this time, when the control section 30 recognizes, on the basis of the bill discrimination information, that the bills being conveyed via the second arc-shaped conveying path 25 are normal, the control section 30 carries out switching, by the switching portion 64, so as to use the first arc-shaped conveying path 24 in the conveying of the bills.

Accordingly, even when the control section 30 conveys the bills, that have been discriminated as being normal, to the second connection position of the first arc-shaped conveying path 24, the control section 30, due to the switching of the conveying path by the switching portion 64, conveys the bills in continuation via the remaining portion of the first arc-shaped conveying path 24, and thereafter, conveys them to the discriminating section 10 again via the rear side conveying path 23.

In this way, in the same way as in the case of the above-described first exemplary embodiment, the control section 30 stores bills that are discriminated as normal in the bill storage cassettes within the lower unit 12.

However, when the control section 30 recognizes, on the basis of the bill discrimination information, that a bill being conveyed via the second arc-shaped conveying path 25 is a counterfeit bill, the control section 30 carries out switching, by the switching portion 64, such that the cassette side conveying path 63 is used in the conveying of that counterfeit bill.

Accordingly, when a counterfeit bill is conveyed to the second connection position of the first arc-shaped conveying path 24, in continuation therewith, the control section 30 conveys the counterfeit bill via the cassette side conveying path 63 to the counterfeit bill storage cassette 61, due to the switching of the conveying path by the switching portion 64.

Then, the counterfeit bill storage cassette 61 stores, in the interior thereof and by the take-in mechanism 61A, the counterfeit bill that has been conveyed via the cassette side conveying path 63.

Further, when, at the time of a deposit, the customer instructs cancellation of the deposit, the control section 30 causes the bills, which are held in the temporary holding section 11, to be separated and drawn-out one-by-one from the temporary holding section 11 by the take-in/draw-out mechanism 11A.

At this time, when the control section 30 recognizes, on the basis of the bill discrimination information, that the bills drawn-out from the temporary holding section 11 are normal, the control section 30 carries out switching by the switching portion 29 so as to use the fourth arc-shaped conveying path 27 and the fifth arc-shaped conveying path 28 in the conveying of the bills ahead of the third arc-shaped conveying path 26.

Accordingly, the control section 30 conveys, via the third arc-shaped conveying path 26, the bills that were drawn-out from the temporary holding section 11 and have been discriminated as being normal, and in continuation thereafter, due to the switching of the conveying path by the switching portion 29, conveys the bills to the bill insertion/take-out section 6 via the fourth arc-shaped conveying path 27 and the fifth arc-shaped conveying path 28 successively.

Due thereto, the control section 30 returns the bills, which have been discriminated as being normal, to the customer via the bill insertion/take-out section 6, in the same way as in the above-described first exemplary embodiment.

However, when the control section 30 recognizes, on the basis of the bill discrimination information, that a bill drawn-out from the temporary holding section 11 is a counterfeit bill, the control section 30 carries out switching, by the switching portion 29, so that the second arc-shaped conveying path 25 is used in the conveying of that counterfeit bill ahead of the third arc-shaped conveying path 26.

Further, at this time, the control section 30 also carries out switching by the switching portion 64 such that the cassette side conveying path 63 is used in the conveying of the counterfeit bill.

Accordingly, the control section 30 conveys a counterfeit bill via the third arc-shaped conveying path 26, and in continuation thereafter, conveys the counterfeit bill via the second arc-shaped conveying path 25 to the first arc-shaped conveying path 24 due to the switching of the conveying path by the switching portion 29.

Then, when the control section 30 conveys this counterfeit bill to the second connection position of the first arc-shaped conveying path 24, in continuation therewith, the control section 30 conveys the counterfeit bill via the cassette side conveying path 63 to the counterfeit bill storage cassette 61 due to the switching of the conveying path by the switching portion 64.

Then, by the take-in mechanism 61A, the counterfeit bill storage cassette 61 take-in and stores in the interior thereof the counterfeit bill conveyed via the cassette side conveying path 63.

In this way, counterfeit bills are recovered together with the counterfeit bill storage cassette 61 by a bank worker or the like, without being stored in the bill storage cassettes within the lower unit 12 and without being returned to customers.

(4-2) Operation and Effects of Fourth Exemplary Embodiment

In the above-described structure, at the automatic teller machine 60, the discriminating side conveying path 20, the holding side conveying path 21 and the insertion/take-out side conveying path 22 at the bill conveying section 62 are structured similarly to the case of the above-described first exemplary embodiment.

In addition, the counterfeit bill storage cassette 61 can be accommodated in and taken-out from the automatic teller machine 60. Further, at the automatic teller machine 60, the cassette control path 63, which connects the counterfeit bill storage cassette 61 and the first arc-shaped conveying path 24, is disposed at the bill conveying section 62, and the switching portion 64 is disposed at the place of connection of this cassette side conveying path 63 and the first arc-shaped conveying path 24.

Further, at the automatic teller machine 60, when the discriminating section 10 discriminates a counterfeit bill among the bills that are the object of a deposit at the time of a deposit, that counterfeit bill is conveyed from the discriminating section 10 to the temporary holding section 11 via the rear side conveying path 23, the first arc-shaped conveying path 24, the second arc-shaped conveying path 25, and the third arc-shaped conveying path 26 successively, and is held together with the bills that have been discriminated as being normal.

However, at the automatic teller machine 60, when, at the time of a deposit, the amount of the deposit is confirmed by the customer, and further, an instruction is given to cancel the deposit, the counterfeit bill is conveyed from the temporary holding section 11 successively via the third arc-shaped conveying path 26, the second arc-shaped conveying path 25, the first arc-shaped conveying path 24 and the cassette conveying path 63 to the counterfeit bill storage cassette 61, and is stored therein.

Accordingly, at the automatic teller machine 60, when a counterfeit bill exists among bills at the time of a deposit, that counterfeit bill can be separated and taken into custody without being stored in the bill storage cassettes within the lower unit 12 and without being returned to customers.

In accordance with the above-described structure, at the automatic teller machine 60, the counterfeit bill storage cassette 61 is provided so as to be able to be accommodated and taken-out, and this counterfeit bill storage cassette 61 and the first arc-shaped conveying path 24 are connected by the cassette side conveying path 63, and the switching portion 64 is disposed at the place of connection of the cassette side conveying path 63 and the first arc-shaped conveying path 24. At the time of a deposit, when a counterfeit bill is discovered among the bills that are the object of the deposit, that counterfeit bill is, due to the switching of the conveying path by the switching portion 64, conveyed to and stored in the counterfeit bill storage cassette 61 via the cassette side conveying path 63.

Due thereto, when a counterfeit bill exists among the bills at the time of a deposit, the automatic teller machine 60 can separate and take that counterfeit bill into custody, without storing it in the bill storage cassettes within the lower unit 12 and without returning it to customers. Therefore, the counterfeit bill can be quickly recovered, together with the counterfeit bill storage cassette 61, by a bank worker or the like.

Further, at the automatic teller machine 60, when all of the bills inserted into the bill insertion/take-out section 6 by a customer at the time of a deposit are discriminated at the discriminating section 10, the control section 30 stores, in an internal memory, bill discrimination information that expresses the order in the discrimination and the results of discrimination of each of the bills.

Accordingly, regardless of whether a first-in first-out type or a first-in last-out type temporary holding section 11 is provided at the automatic teller machine 60, in a case in which a counterfeit bill is held in the temporary holding section 11 together with bills that have been discriminated as being normal, the counterfeit bill can, on the basis of the bill discrimination information, be easily and reliably differentiated from the other bills and stored in the counterfeit bill storage cassette 61.

(5) Other Exemplary Embodiments

Note that the above-described first through fourth exemplary embodiments describe cases in which the one switching portion 29 is disposed at the conveying path surrounded space that is the place of connection of the discriminating side conveying path 20, 42, the holding side conveying path 21, 52 and the insertion/take-out side conveying path 22, 43.

Figure 10:
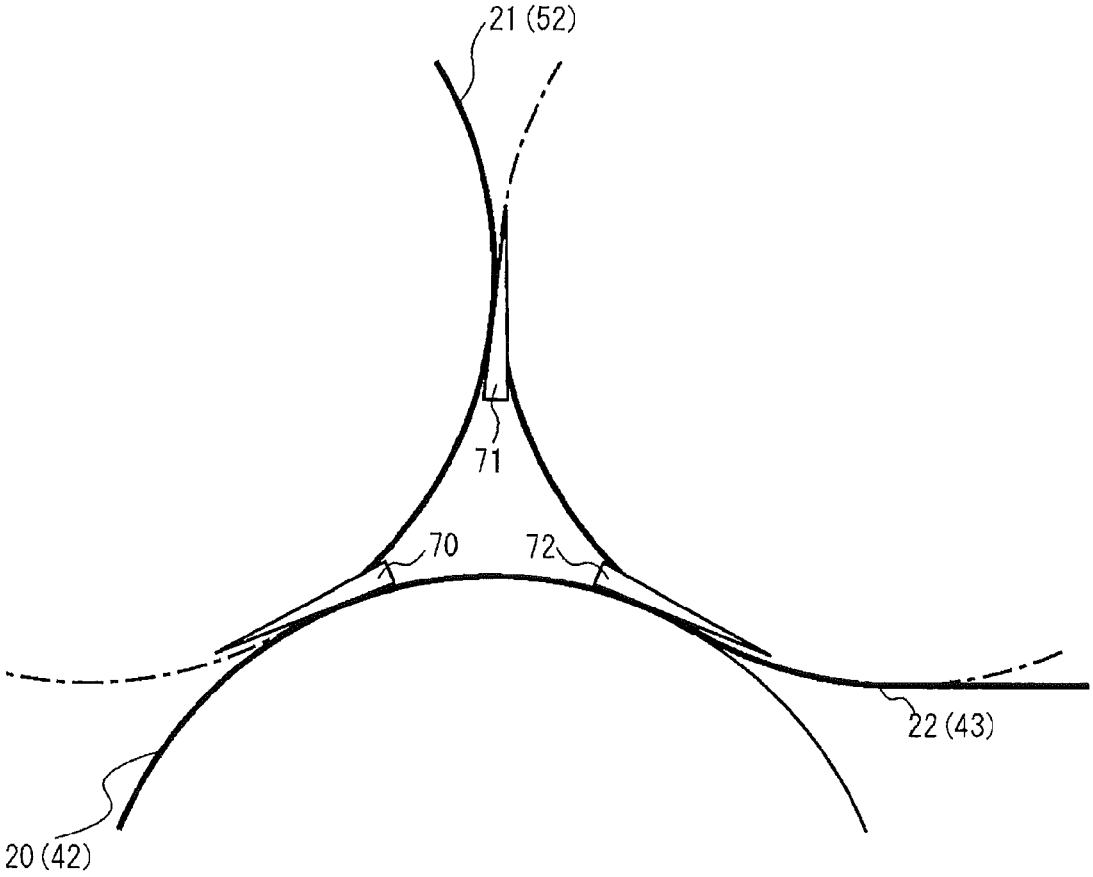
FIG. 10 is a rough line drawing that provides an explanation of placement of switching portions with respect to places of connection of conveying paths in accordance with another exemplary embodiment.

However, the present invention is not limited to the same. As shown in FIG. 10, switching portions 70 through 72 may be disposed in the conveying path surrounded space respectively at the place of connection of the discriminating side conveying path 20, 42 and the holding side conveying path 21, 52, and the place of connection of the holding side conveying path 21, 52 and the insertion/take-out side conveying path 22, 43, and the place of connection of the insertion/take-out side conveying path 22, 43 and the discriminating side conveying path 20, 42.

In the present invention, also due to this structure, the conveying direction can be prevented from changing suddenly at the time when a bill passes through the place of connection of the discriminating side conveying path 20, 42 and the holding side conveying path 21, 52, and the place of connection of the holding side conveying path 21, 52 and the insertion/take-out side conveying path 22, 43, and the place of connection of the insertion/take-out side conveying path 22, 43 and the discriminating side conveying path 20, 42.

Accordingly, also due to this structure, the present invention can greatly reduce the occurrence of jams when a bill passes through the places of connection of the conveying paths and can prevent a decrease in the conveying efficiency of the bills, in the same way as in the cases of the above-described first through fourth exemplary embodiments.

Further, the above first through fourth exemplary embodiments describe cases in which the first arc-shaped conveying path 24, 45 is structured by using a conveying driving section that is formed from the plural drive rollers 24A, 45A, the plural tension rollers 24B, 45B, and the like.

Figure 11:
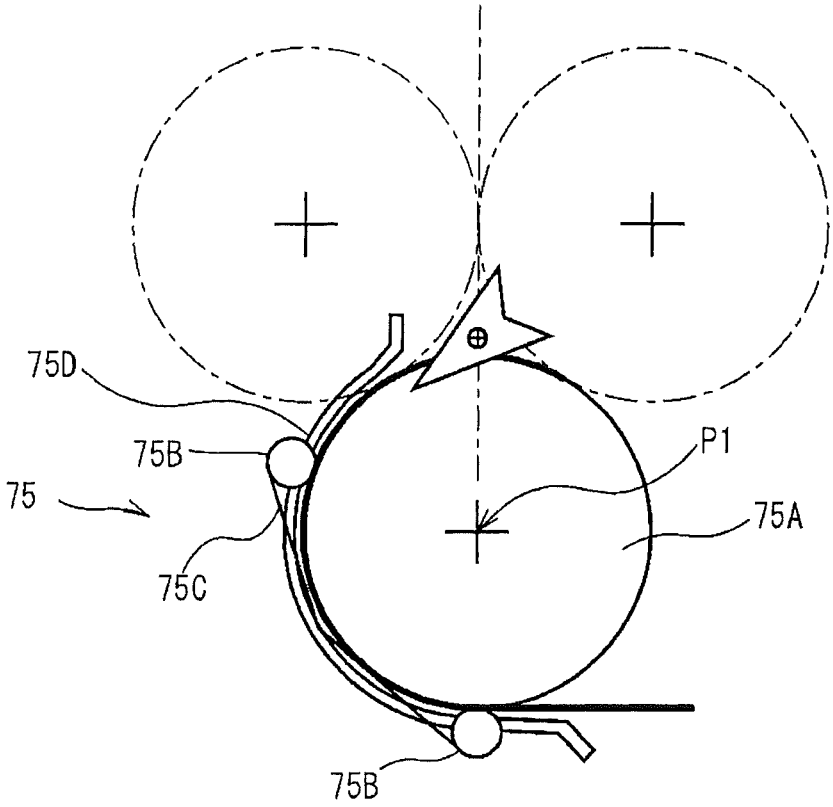
FIG. 11 is a rough line drawing showing the structure of a first arc-shaped conveying path in accordance with another exemplary embodiment.

However, the present invention is not limited to the same. As shown in FIG. 11, a first arc-shaped conveying path 75 may be structured by using a conveying driving section that is formed from a first drive roller 75A that has a radius equal to the first radius R1 and that is solid-cylindrical for example, plural second drive rollers 75B that have radii smaller than the first radius R1, plural conveying belts 75C, a conveying guide 75D, and the like.

In this case, one drive shaft is supported at the first center P1 so as to be rotatable in one direction and another direction in a posture of being parallel to the leftward direction, and one end of the drive shaft is connected to the driving shaft of an unillustrated motor.

A hole portion (not illustrated) is formed in the center of the first drive roller 75A, and the first drive roller 75A is mounted via this hole portion to the drive shaft at the first center P1.

Further, for example, two other drive shafts are supported so as to be rotatable in one direction and another direction in a posture of being parallel to the leftward direction and adjacent to the peripheral side surface of the first drive roller 75A respectively, at the position of one end of the first arc-shaped conveying path 75 and a predetermined position that is slightly further toward the one end side than the first connection position. Note that respective one ends of these other two drive shafts as well are connected to the driving shaft of an unillustrated motor.

Hole portions (not illustrated) are formed in the respective centers of the plural second drive rollers 75B, and a predetermined number of the second drive rollers 75B are mounted at predetermined intervals (i.e., so as to face the peripheral side surface of the first drive roller 75A) on each drive shaft via the hole portions.

Further, the plural conveying belts 75C are trained around the second drive rollers 75B, which are at the position of the one end of the first arc-shaped conveying path 75, and the second drive rollers 75B, which are at the predetermined position slightly further toward the one end side than the first connection position, and portions of the surfaces thereof go along the peripheral side surface of the first drive roller 75A.

Accordingly, due to the conveying driving section driving and rotating the drive shaft at the first center P1 via the motor, the first drive roller 75A can be rotated in the one direction and the other direction around that drive shaft (i.e., the first center P1).

Further, the conveying driving section drives and rotates the other two drive shafts via the motor, so as to rotate them in the direction opposite that of the drive shaft at the first center P1.

Accordingly, when the conveying driving section drives and rotates these other two drive shafts via the motor, the plural second drive rollers 75B are rotated in the other direction and the one direction around these drive shafts, and, interlockingly therewith, the conveying belts 75C are rotated in the other direction and the one direction, which are opposite to the aforementioned directions, while being pushed against the peripheral side surface of the first drive roller 75A.

In addition, the conveying guide 75D is formed in a substantial arc shape so as to go along the circumference of a circle whose radius is slightly larger than the first radius R1 for example. Hole portions that pass from the outer side to the inner side are formed in the conveying guide 75D in correspondence with the plural conveying belts 75C.

Further, the respectively corresponding conveying belts 75C are inserted into the plural hole portions of the conveying guide 75D, and the conveying guide 75D is disposed, for example, from a vicinity of the one end of the first arc-shaped conveying path 75 to a vicinity of the first connection position, with the inner surface thereof being adjacent to the peripheral side surface of the first drive roller 75A.

On the basis of this structure, when a bill is conveyed via the rear side conveying path 23, the conveying driving section of the first arc-shaped conveying path 75 rotates the first drive roller 75A and the plural conveying belts 75C in the one direction and the other direction that are opposite to one another.

Due thereto, the conveying driving section of the first arc-shaped conveying path 75 takes-in a bill from the one end side so as to nip the bill between the first drive roller 75A and the plural conveying belts 75C, and, on the other hand, pushes the bill out at the other end side and conveys the bill to the second arc-shaped conveying path 25 or the fifth arc-shaped conveying path 28.

Further, when a bill is conveyed via the second arc-shaped conveying path 25, the conveying driving section of the first arc-shaped conveying path 75 rotates the first drive roller 75A and the plural conveying belts 75C in the other direction and the one direction that are opposite to one another.

Due thereto, the conveying driving section of the first arc-shaped conveying path 75 takes-in the bill from the other end side so as to nip the bill between the first drive roller 75A and the plural conveying belts 75C, and, on the other hand, pushes the bill out at the one end side and conveys the bill to the rear side conveying path 23.

Even when using the first arc-shaped conveying path 75 of this structure, the present invention can convey bills in the same way as in the cases of the above-described first through fourth exemplary embodiments.

Further, the above first through fourth exemplary embodiments describe cases in which the holding side conveying path 21, 52 is structured by the second arc-shaped conveying path 25 and the third arc-shaped conveying path 26, 53.

Figure 12:
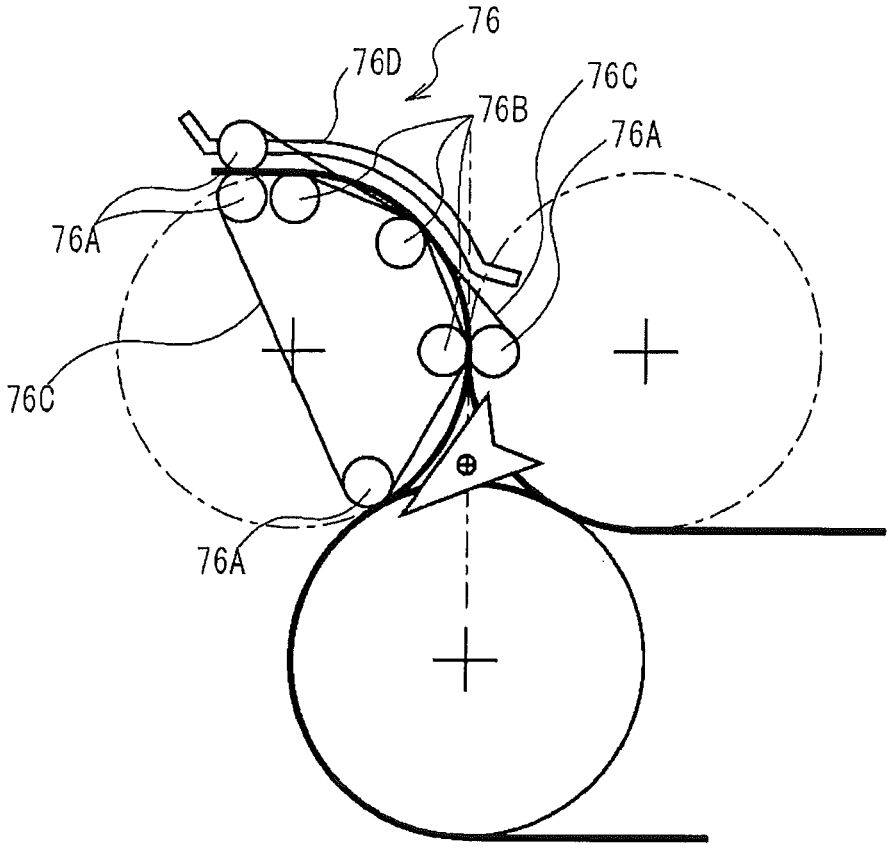
FIG. 12 is a rough line drawing showing the structure of a holding side conveying path in accordance with another exemplary embodiment.

However, the present invention is not limited to the same, and a holding side conveying path 76 may overall be structured as one conveying path as shown in FIG. 12.

Namely, in the case of this structure in the present invention, a conveying driving section, which is similar to that of the second arc-shaped conveying path 25 in accordance with the above-described first through fourth exemplary embodiments, is provided at the holding side conveying path 76.

In this case, at the conveying driving section of the holding side conveying path 76, two of plural drive shafts are supported so as to be rotatable in one direction and the other direction in a posture of being parallel to the leftward direction respectively, at, for example, two positions that face one another across the arc of the holding side conveying path 76 on a normal line that passes through one end of this arc.

Further, other two drive shafts of the plural drive shafts are supported so as to be rotatable in one direction and the other direction in a posture of being parallel to the leftward direction, at, for example, two positions that face one another across the other end of the holding side conveying path 76 on an imaginary line that is parallel to the upward direction and that passes through this other end of the holding side conveying path 76. Respective one ends of these plural drive shafts are connected to the driving shafts of motors.

Moreover, plural idle shafts are supported so as to be rotatable in one direction and the other direction in a posture of being parallel to the leftward direction respectively, between the drive shaft at the inner side of the arc and the drive shaft at the lower side of the other end, at predetermined intervals along the arc and the other end side horizontal portion.

On the other hand, plural drive rollers 76A respectively have the same radius which is smaller than the first radius R1, and hole portions (not illustrated) are formed in the centers thereof.

A predetermined number of the plural drive rollers 76A are mounted via the hole portions to each drive shaft at predetermined intervals.

Plural idle rollers 76B respectively have the same radius as the drive rollers 76A, and hole portions (not illustrated) are formed in the centers thereof.

Further, the plural idle rollers 76B are mounted at predetermined intervals (i.e., so as to be lined-up with the drive rollers 76A along the arc and the other end side horizontal portion) to each idle shaft via the hole portions, in the same number as the number of the drive rollers 76A that are mounted to each drive shaft.

Plural conveying belts 76C are trained around from the one drive rollers 76A, which are lined-up in a row along the inner side of the arc and the lower side of the other end side horizontal portion respectively, via the plural idle rollers 76B to the other drive rollers 76A, and portions of the surfaces of the plural conveying belts 76C go along the arc and the other end side horizontal portion.

Due thereto, when the conveying driving section, via the motors, drives and rotates the drive shafts that are disposed at the inner side of the arc and the lower side of the other end side horizontal portion, the plural drive rollers 76A are rotated in the one direction and the other direction around these drive shafts, and interlockingly therewith, the conveying belts 76C can be rotated in the one direction and the other direction in a state in which portions of the surfaces thereof go along the arc and the other end side horizontal portion.

Further, the plural conveying belts 76C are also trained around from the one drive rollers 76A, which are lined-up in a row along the outer side of the arc and the upper side of the other end side horizontal portion respectively, to the other drive rollers 76A, and portions of the surfaces thereof are pushed against portions of the surfaces of the opposing conveying belts 75C that are at the inner side of the arc.

Further, via the motors, the conveying driving section drives and rotates the drive shafts, that are disposed at the outer side of the arc and the upper side of the other end side horizontal portion, so as to rotate these drive shafts in the opposite direction of the drive shafts that are disposed at the inner side of the arc and the lower side of the other end side horizontal portion.

Accordingly, when the conveying driving section, via the motors, drives and rotates the drive shafts that are disposed at the outer side of the arc and the upper side of the other end side horizontal portion, the plural drive rollers 76A are rotated in the other direction and the one direction around these drive shafts, and interlockingly therewith, the conveying belts 76C can be rotated in the other direction and the one direction, which are opposite to the aforementioned directions, while pushing against the conveying belts 76C that rotate at the inner side of the arc and the lower side of the other end side horizontal portion.

In addition, a conveying guide 76D is formed in a substantial arc shape so as to go along the circumference of a circle whose radius is slightly larger than the first radius R1 for example. Hole portions, which pass through from the outer surface of the inner surface, are formed in the conveying guide 76D in correspondence with the plural conveying belts 76C that are positioned at the outer side of the arc and the upper side of the other end side horizontal portion.

The corresponding conveying belts 76C at the outer side of the arc and the upper side of the other end side horizontal portion are inserted respectively into the plural hole portions of the conveying guide 76D, and the conveying guide 76D is disposed, for example, so as to extend from a vicinity of the central portion of the holding side conveying path 76 to a vicinity of the other end, and such that the inner surface of the conveying guide 76D is adjacent to the surfaces of the conveying belts 76C at the inner side of the arc and the lower side of the other end side horizontal portion.

On the basis of this structure, when a bill is conveyed via the first arc-shaped conveying path 24, the conveying driving section of the holding side conveying path 76 rotates the plural conveying belts 76C, which are at the inner side of the arc and the lower side of the other end side horizontal portion, and the plural conveying belts 76C, which are at the outer side of the arc and the upper side of the other end side horizontal portion, in the other direction and the one direction that are opposite one another.

Due thereto, the conveying driving section of the holding side conveying path 76 takes-in the bill from the one end side so as to nip the bill between the facing conveying belts 76C, and, on the other hand, pushes the bill out at the other end side and conveys the bill to the temporary holding section 11.

Further, when a bill is drawn-out from the temporary holding section 11, the conveying driving section of the holding side conveying path 76 rotates the plural conveying belts 76C, which are at the inner side of the arc and the lower side of the other end side horizontal portion, and the plural conveying belts 76C, which are at the outer side of the arc and the upper side of the other end side horizontal portion, in the one direction and the other direction that are opposite to one another.

Due thereto, the conveying driving section of the holding side conveying path 76 takes-in the bill from the other end side so as to nip the bill between the facing conveying belts 76C, and, on the other hand, pushes the bill out at the one end side and conveys the bill to the first arc-shaped conveying path 24 or the fourth arc-shaped conveying path 27.

Even when using the holding side conveying path 76 of this structure, the present invention can convey bills in the same way as in the cases of the above-described first through fourth exemplary embodiments.

Further, the discriminating side conveying path and the insertion/take-out side conveying path respectively also may similarly be structured overall by one conveying path.

Moreover, the holding side conveying path and the insertion/take-out side conveying path respectively may be formed as one conveying path by combining an arc-shaped portion and a rectilinear portion.

Namely, these other various structures of the discriminating side conveying path, the holding side conveying path and the insertion/take-out side conveying path can be broadly applied to the invention of the present application.

Further, the above fourth exemplary embodiment describes a case in which the counterfeit bill storage cassette 61 and the first arc-shaped conveying path 24 are connected by the cassette side conveying path 63 that is substantially rectilinear and is disposed parallel to an obliquely rearward and downward direction.

Figure 13:
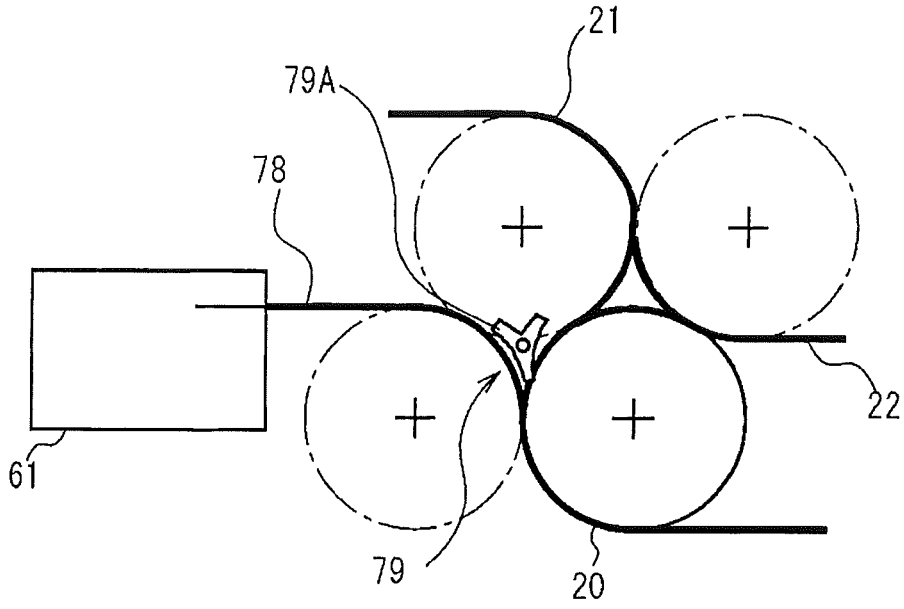
FIG. 13 is a rough line drawing showing the structure of a cassette side conveying path in accordance with another exemplary embodiment.

However, the present invention is not limited to the same. For example, as shown in FIG. 13, the counterfeit bill storage cassette 61 and the first arc-shaped conveying path 24 may be connected by a cassette side conveying path 78 at which a partial segment is formed in an arc shape.

In this case, in the present invention, one end portion at the cassette side conveying path 78 is formed in a rectilinear shape for example, and the other end portion is formed in an arc shape that uses, as a reference, the circumference of a circle of the first radius R1.

In the present invention, the outer side of the arc of the cassette side conveying path 78 is directed obliquely frontward and upward, and one end of the cassette side conveying path 78 is connected to the take-in end of the counterfeit bill storage cassette 61, and the other end is connected to a predetermined position of the first arc-shaped conveying path 24 such that the outer sides of the arcs face one another.

Further, in the present invention, a switching portion 79 is disposed at the place of connection between the cassette side conveying path 78 and the first arc-shaped conveying path 24. The switching portion 79 has a switching blade 79A that is substantially wedge-shaped and at whose one and other side surface are formed arc-shaped cut-out portions that correspond to the arc-shapes (i.e., the shapes and lengths of the arcs, and the heights from the connection points to the vertices) of the cassette side conveying path 78 and the first arc-shaped conveying path 24 respectively.

By the switching portion 79, the present invention switches the conveying path that is used in the conveying of bills to one of the first arc-shaped conveying path 24 and the cassette side conveying path 78.

In the present invention, in accordance with this structure, when a counterfeit bill is discriminated by the discriminating section 10, that counterfeit bill is conveyed from the discriminating section 10 to the rear side conveying path 23 and midway along the first arc-shaped conveying path 24 without being conveyed to and temporarily held in the temporary holding section 11. Thereafter, the counterfeit bill is guided to the cassette side conveying path 78 by the switching portion 79, and can be conveyed to and stored in the counterfeit bill storage cassette 61 via the cassette side conveying path 78.

Namely, in accordance with the above-described structure, at the time a counterfeit bill is discriminated, the present invention can separate that counterfeit bill and can store it in the counterfeit bill storage cassette 61, without placing it together with normal bills.

Further, the above fourth exemplary embodiment describes a case in which a bill is conveyed via the plural conveying paths (including the discriminating side conveying path 20, the holding side conveying path 21, and the insertion/take-out side conveying path 22) with one long side of the bill facing in the conveying direction.

However, the present invention is not limited to the same, and a bill may be conveyed via the plural conveying paths (including the discriminating side conveying path 20, the holding side conveying path 21, and the insertion/take-out side conveying path 22) with one short side of the bill facing in the conveying direction (i.e., with the longitudinal direction of the bill being substantially parallel tot the conveying direction).

Moreover, the above first through fourth exemplary embodiments describe, with reference to FIG. 1 through FIG. 13, cases in which the paper sheet conveying device of the present invention is applied to the bill conveying section 19, 41, 51, 62 that is provided at the above-described automatic teller machine 1, 40, 50, 60.

However, the present invention is not limited to the same, and can be broadly applied to paper sheet conveying sections that convey paper sheets such as bills, tickets or the like and that are provided at other various types of devices such as cash dispensers (CDs) and money exchanging machines, automatic vending machines for beverages or cigarettes or the like, ticket vending machines that sell train tickets or tickets for performances, fare adjustment machines, gaming machines such as pachinko machines or slot machines, and the like.

Moreover, the above first through fourth exemplary embodiments describe, with reference to FIG. 1 through FIG. 13, cases in which the automatic cash transaction device of the present invention is applied to the above-described automatic teller machine 1, 40, 50, 60.

However, the present invention is not limited to the same, and can be broadly applied to other various types of automatic cash transaction devices that handle paper sheets like bills, tickets or the like, such as cash dispensers and money exchanging machines, automatic vending machines for beverages or cigarettes or the like, ticket vending machines that sell train tickets or tickets for performances, fare adjustment machines, gaming machines such as pachinko machines or slot machines, and the like.

Further, the above first through fourth exemplary embodiments describe, with reference to FIG. 1 through FIG. 13, cases in which the above-described bills are used as the paper sheets that are conveyed via at least three or more conveying paths at each of which at least a partial segment is formed in an arc shape.

However, the present invention is not limited to the same, and can broadly utilize other various types of paper sheets such as printed paper like tickets, bankbooks and transaction statements, or the like as the paper sheets that are conveyed via at least three or more conveying paths at each of which at least a partial segment is formed in an arc shape.

Moreover, the above first through fourth exemplary embodiments describe, with reference to FIG. 1 through FIG. 13, cases in which the above-described discriminating side conveying path 20, 42, holding side conveying path 21, 52 and insertion/take-out side conveying path 22, 43 are used as the at least three or more conveying paths that are for conveying paper sheets and at each of which at least a partial segment is formed in an arc shape.

However, the present invention is not limited to the same, and can broadly utilize conveying paths of other various types of structures provided that at least a partial segment of each conveying path is formed in an arc shape, such as a conveying path that is formed as a single conveying path overall, a conveying path that is formed by combining two or more conveying paths, three or more conveying paths for connecting together plural places including the discriminating section 10, the temporary holding section 11 and the bill insertion/take-out section 6 or sections other than these, plural conveying paths that are formed in arc shapes by using, as references, circumferences of circles having different radii, and the like.

Further, the above first through fourth exemplary embodiments describe, with reference to FIG. 1 through FIG. 13, cases in which the above-described one switching portion 29 is used as the at least one or more switching portion for switching the conveying path that conveys the paper sheets.

However, the present invention is not limited to the same, and can broadly utilize switching portions of other various types of structures such as switching portions that are respectively disposed at places of connection of plural conveying paths, a switching portion that is disposed so as to be able to be used in common at two or more places of connection, and the like.

What is claimed is:

1. A paper sheet conveying device comprising:

at least three or more conveying paths that convey paper sheets and at each of which at least a partial segment is formed in an arc shape; and at least one or more switching portions that switch the plurality of conveying paths that convey the paper sheets;

wherein the plurality of conveying paths are disposed such that two connection positions of each of the arc-shaped segments are connected to the connection position of the arc-shaped segment of a respectively different one of the conveying paths such that outer sides of arcs face one another; and wherein the switching portion switches the plurality of conveying paths that convey the paper sheets at a plurality of places of connection of the plurality of conveying paths.

2. The paper sheet conveying device of claim 1, wherein a number of the plurality of conveying paths is three, and at least regions between the two connection positions of the respective arc-shaped segments are formed in arc shapes on the basis of circumferences of circles whose radii are equal.

3. The paper sheet conveying device of claim 2, wherein:

the switching portion has a switching blade at which cut-out portions, which are shaped as arcs that are similar to arc shapes of the regions between the two connection positions, are formed at one and another side surface that contact at an acute angle at a distal end; and the switching blade is rotatably disposed at a central portion of a space that is surrounded by the regions between the two connection positions of the respective three conveying paths.

4. The paper sheet conveying device of claim 1, wherein:

a number of the plurality of conveying paths is three; and at least one conveying path among the three conveying paths has a plurality of drive rollers that have radii that are smaller than radii of circles that are used in order to form regions between two connection positions in arc shapes, and that are for conveying the paper sheets along the arc-shaped segment.

5. The paper sheet conveying device of claim 1, wherein:

a number of the plurality of conveying paths is three; and at least one conveying path among the three conveying paths has a drive roller that has a radius that is equal to radii of circles that are used in order to form regions between two connection positions in arc shapes, and that is for conveying the paper sheets along the arc-shaped segment.

6. An automatic cash transaction device comprising:

at least three or more conveying paths that are connected to one another at at least three or more places, and that convey paper sheets, and at each of which at least a partial segment is formed in an arc shape; and at least one or more switching portions that switch the plurality of conveying paths that convey the paper sheets, wherein the plurality of conveying paths are disposed such that two connection positions of each of the arc-shaped segments are connected to the connection position of the arc-shaped segment of a respectively different one of the conveying paths such that outer sides of arcs face one another; and wherein the switching portion switches the plurality of conveying paths that convey the paper sheets at a plurality of places of connection of the plurality of conveying paths.

* * * * *